US010823525B1

(12) United States Patent
Stevens

(10) Patent No.: US 10,823,525 B1
(45) Date of Patent: Nov. 3, 2020

(54) ARROW REST ASSEMBLY

(71) Applicant: BowTech, Inc., Eugene, OR (US)

(72) Inventor: Joshua R. Stevens, Corvallis, OR (US)

(73) Assignee: BowTech, Inc., Eugene, OR (US)

( * ) Notice: Subject to any disclaimer, the term of this patent is extended or adjusted under 35 U.S.C. 154(b) by 0 days.

(21) Appl. No.: 16/742,784

(22) Filed: Jan. 14, 2020

(51) Int. Cl.
*F41B 5/22* (2006.01)
*F41B 5/14* (2006.01)
*F41B 5/10* (2006.01)

(52) U.S. Cl.
CPC ..... *F41B 5/143* (2013.01); *F41B 5/105* (2013.01)

(58) Field of Classification Search
CPC ..... F41B 5/143
USPC ..... 124/24.1, 25.6
See application file for complete search history.

(56) References Cited

U.S. PATENT DOCUMENTS 3,342,173 A 9/1967 Ferguson
4,287,868 A 9/1981 Schiff
4,473,058 A 9/1984 Terry
4,489,704 A 12/1984 Troncoso
4,548,189 A 10/1985 Pietraszek et al.
4,676,220 A 6/1987 Pietraszek
4,803,971 A 2/1989 Fletcher
5,235,958 A 8/1993 Laffin
5,503,136 A 4/1996 Tone
6,044,832 A 4/2000 Piersons
6,050,251 A 4/2000 Harwath et al.
6,082,348 A 7/2000 Savage
6,102,020 A 8/2000 Mizek et al.
6,178,959 B1 1/2001 Troncoso et al.
6,561,174 B1 5/2003 Afshari
6,688,296 B1 2/2004 Greywall
6,688,297 B1 2/2004 Clague
7,963,279 B2 6/2011 Harwath et al.
8,434,464 B1 * 5/2013 Terzo ..... F41B 5/143 124/44.5
8,544,457 B1 10/2013 Munsell et al.
2004/0139953 A1 * 7/2004 Harwath ..... F41B 5/143 124/44.5
2007/0163560 A1 7/2007 Mertens
2007/0221186 A1 9/2007 Grace et al.
2008/0236556 A1 10/2008 Sims et al.
(Continued)

*Primary Examiner* — John E Simms, Jr.
(74) *Attorney, Agent, or Firm* — David S. Alavi

(57) ABSTRACT

An arrow rest assembly includes a launcher, a lever, a launcher-lever coupler, and a switch. The launcher moves between launcher-up and launcher-down positions, biased toward launcher-up; the lever moves between brace and drawn positions, biased toward drawn; the coupler moves between coupled and decoupled arrangements, biased toward coupled. When coupled, the launcher and lever move together in an aligned arrangement, including launcher-down with brace and launcher-up with drawn. When decoupled: the launcher and lever move independently, with biased movement of the launcher to launcher-up; and movement of the launcher and lever into the aligned arrangement enables biased movement of the coupler to the coupled arrangement. When coupled and with the lever in the brace position, actuating the switch, using the shaft of an arrow nocked or positioned to be nocked, moves the coupler to the decoupled arrangement and allows biased movement of the launcher to the launcher-up position.

19 Claims, 15 Drawing Sheets

(56) References Cited

U.S. PATENT DOCUMENTS

| | | | | |
|---|---|---|---|---|
| 2011/0139138 | A1* | 6/2011 | Geno | F41B 5/143 124/44.5 |
| 2013/0255654 | A1 | 10/2013 | Nystrom | |
| 2015/0184972 | A1* | 7/2015 | Grace | F41B 5/143 124/44.5 |
| 2016/0341512 | A1 | 11/2016 | Grace | |
| 2017/0191788 | A1* | 7/2017 | Eacker | F41B 5/143 |
| 2018/0058798 | A1* | 3/2018 | Coalson | F41B 5/143 |

* cited by examiner

FIG. 1C
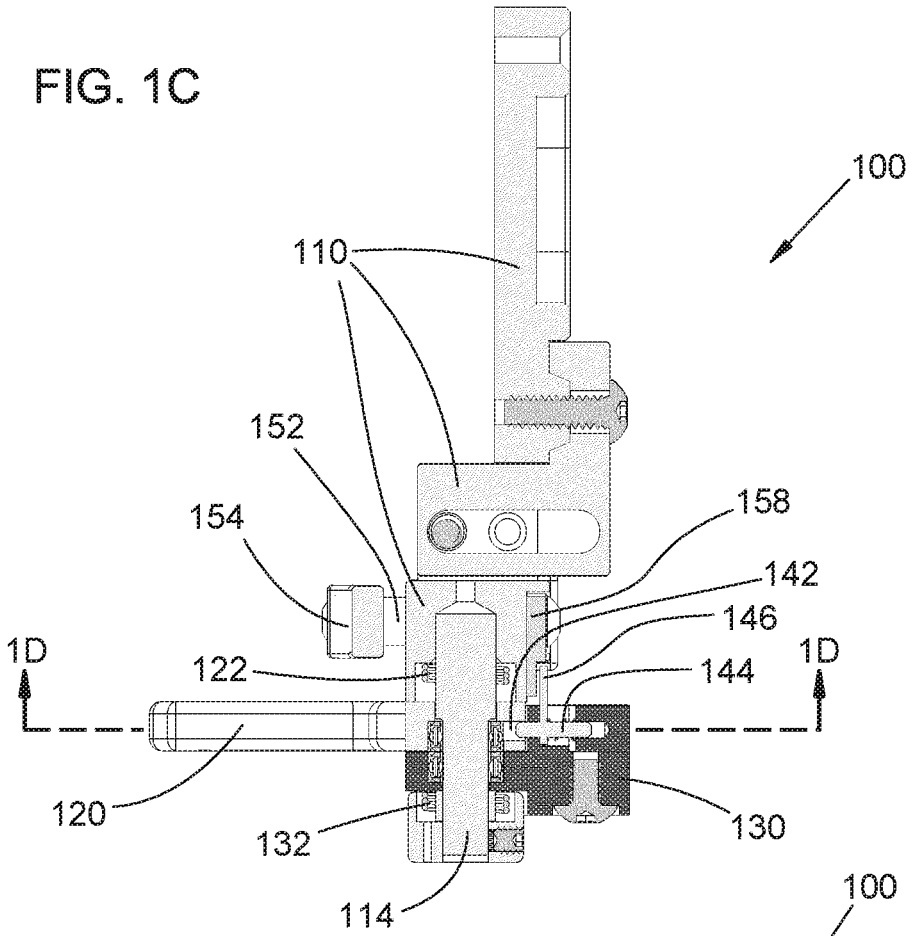
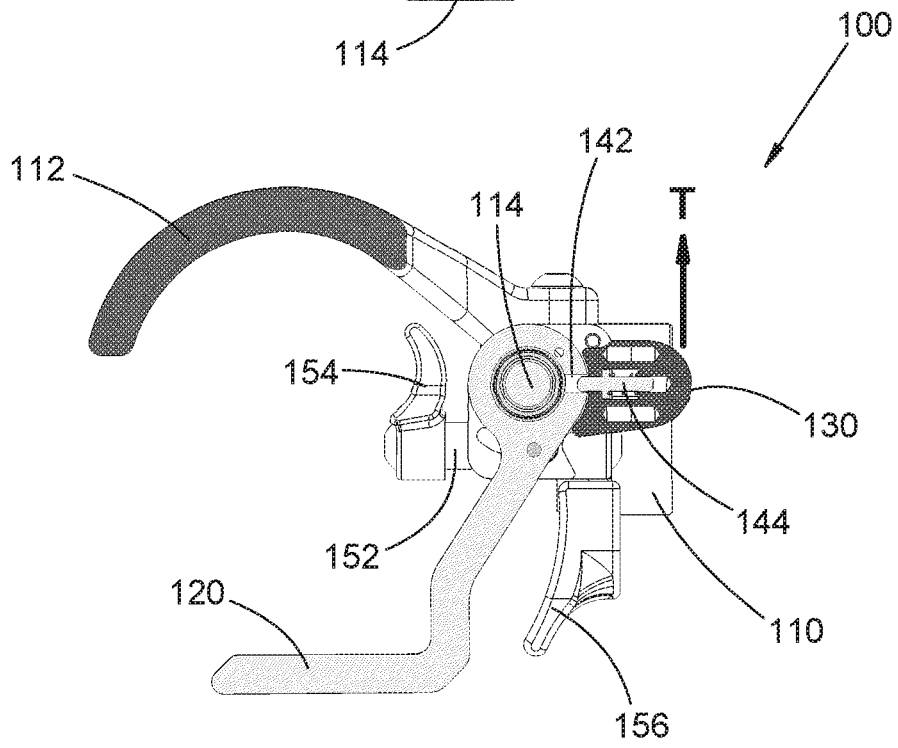
FIG. 1D

FIG. 2C
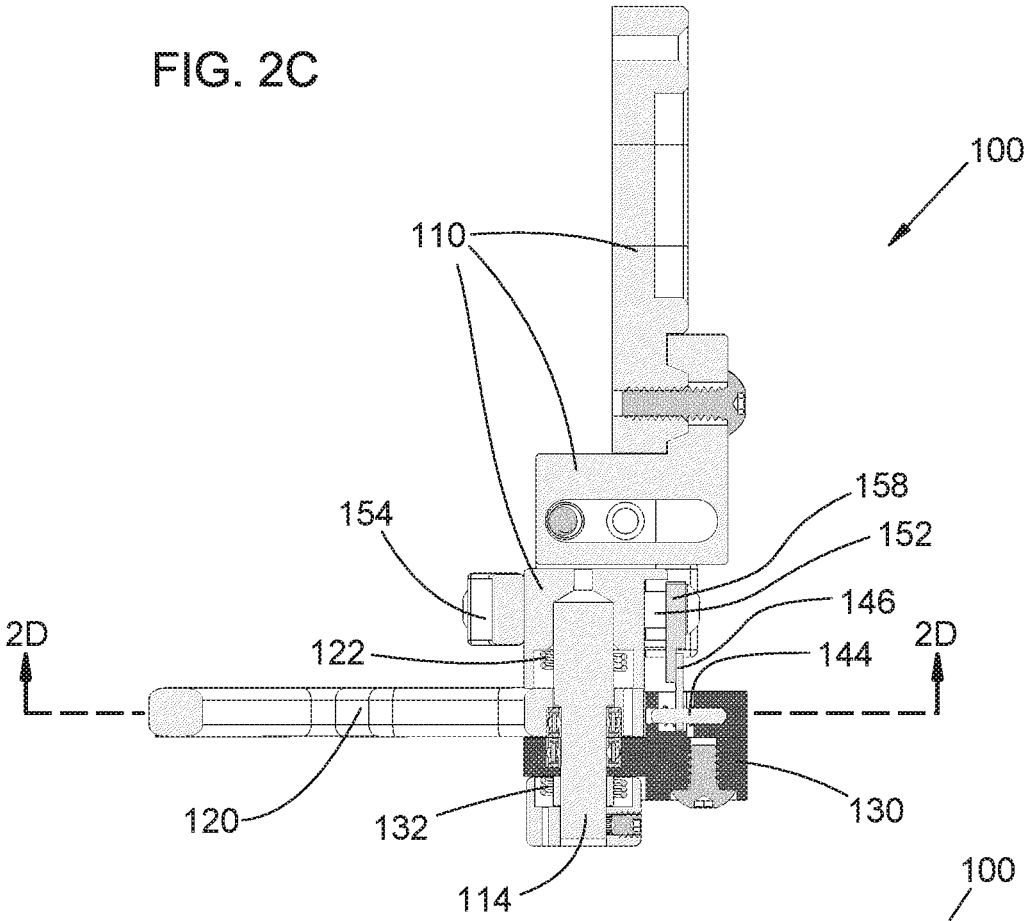
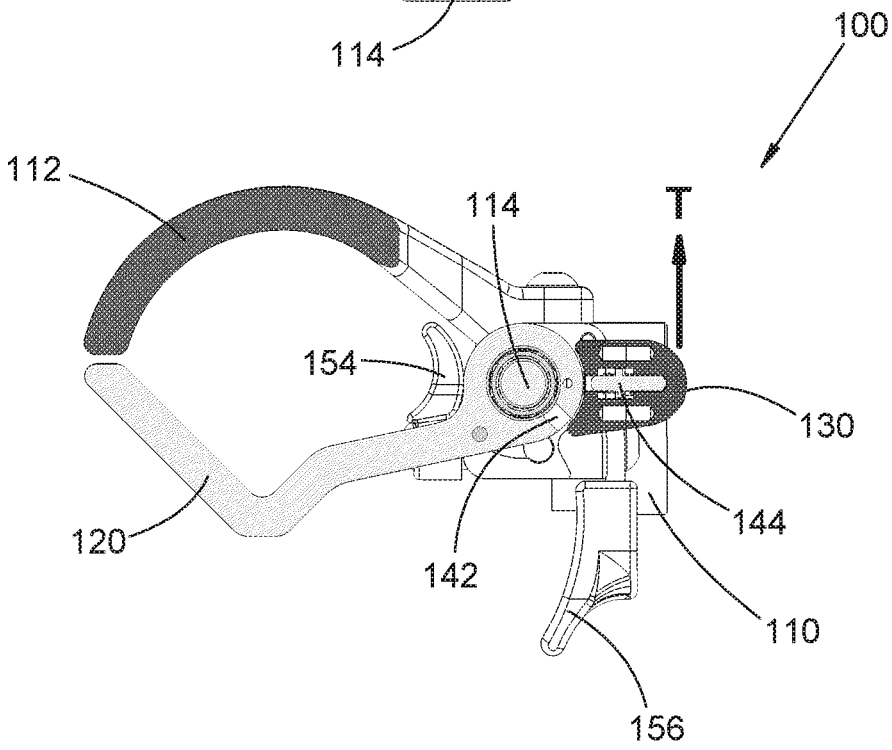
FIG. 2D

FIG. 3C
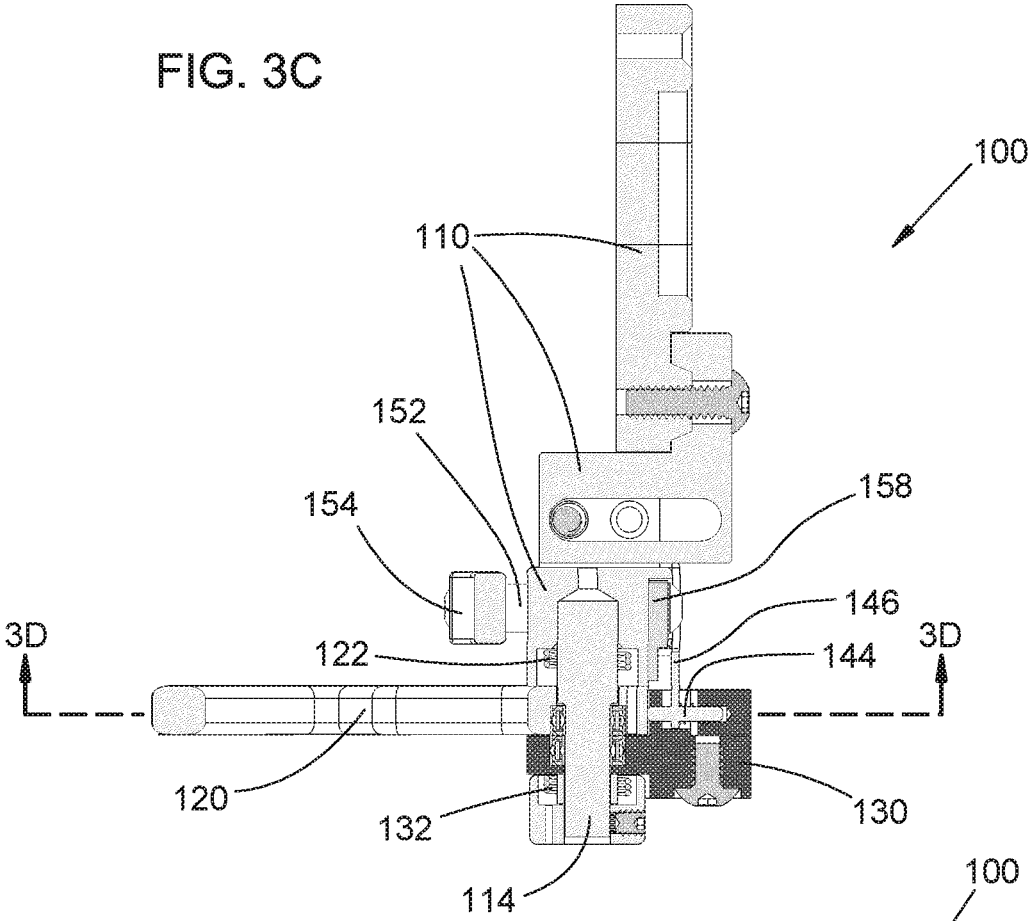
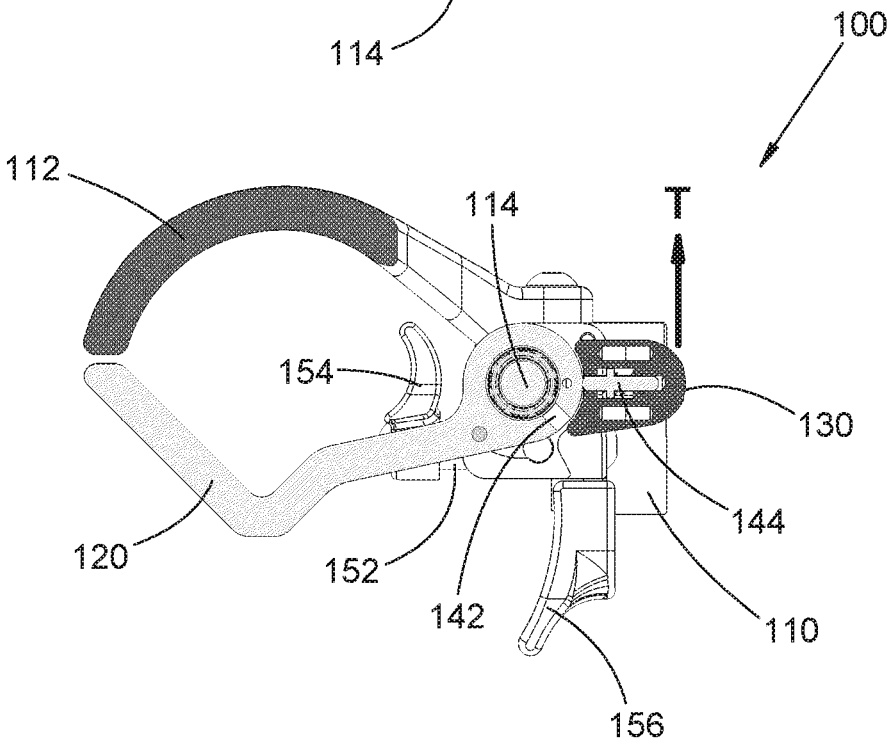
FIG. 3D

FIG. 4C
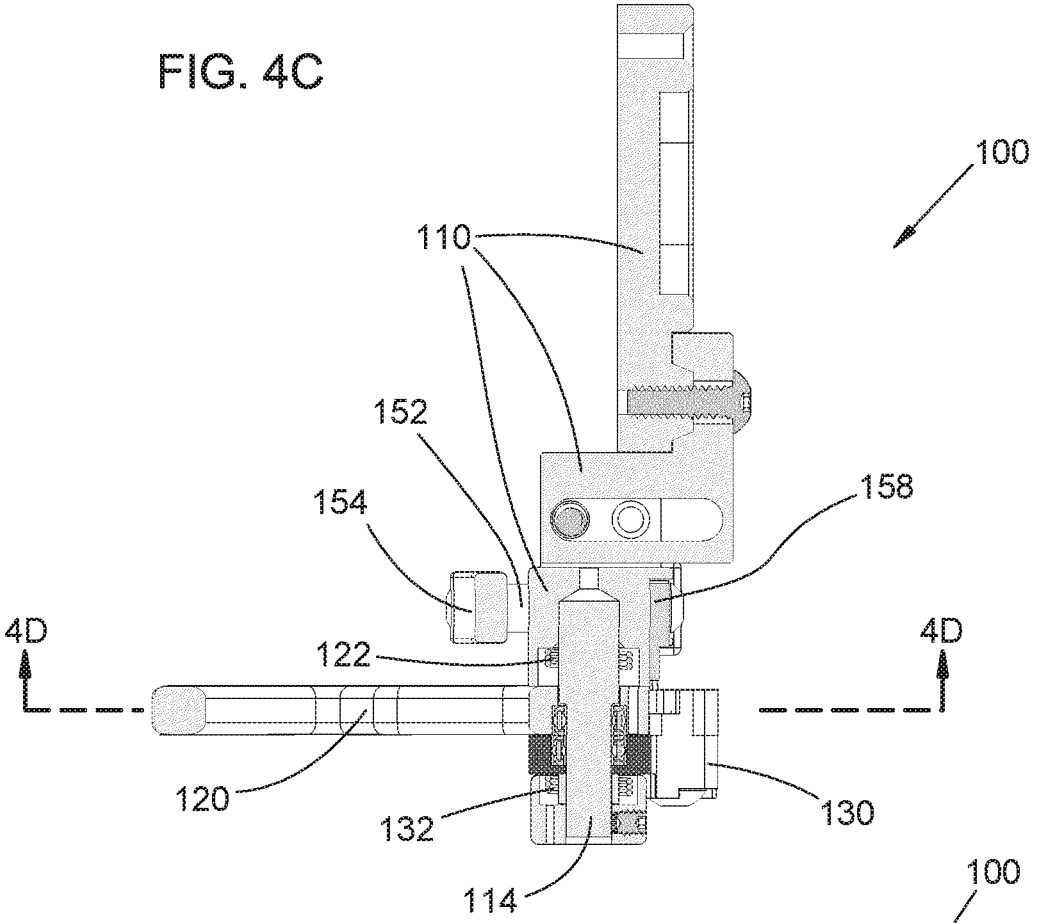
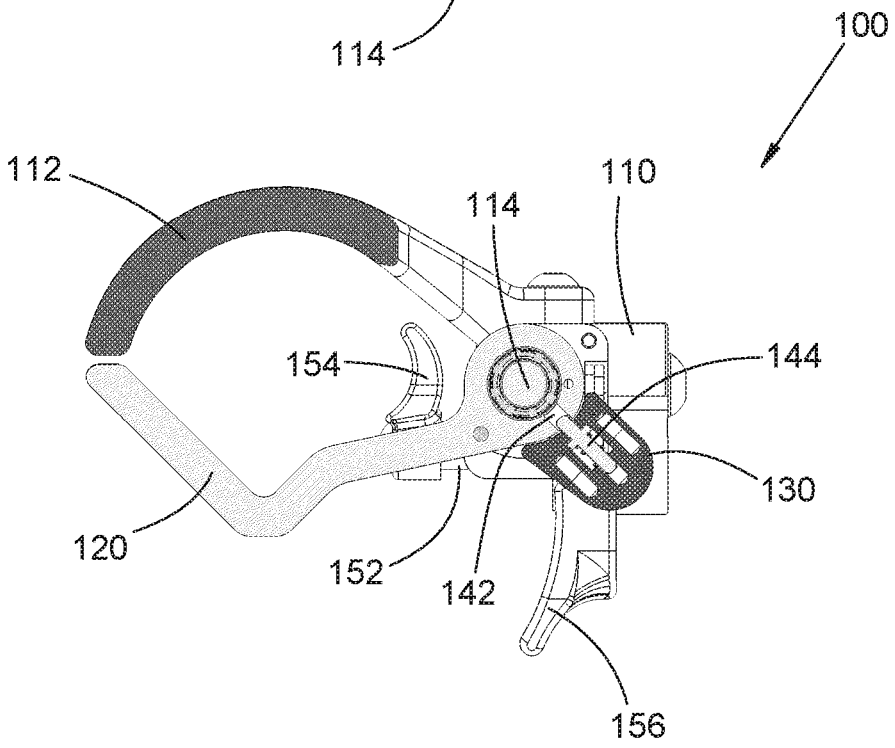
FIG. 4D

FIG. 6A
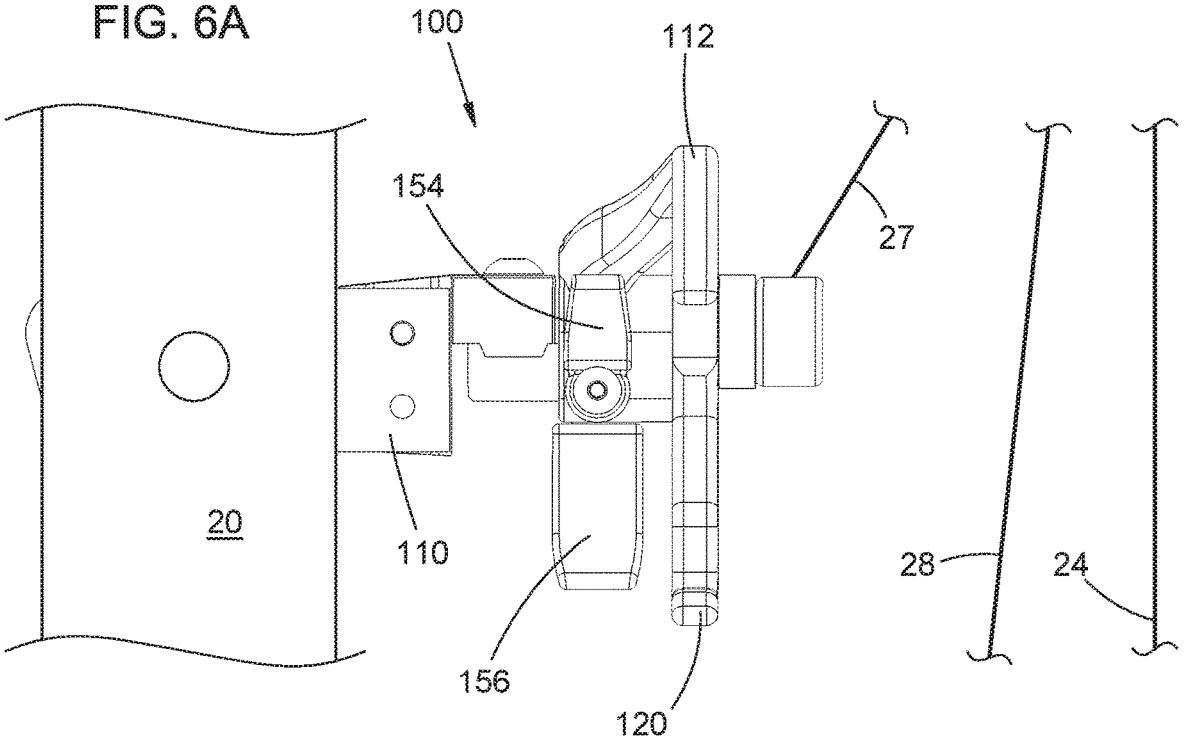
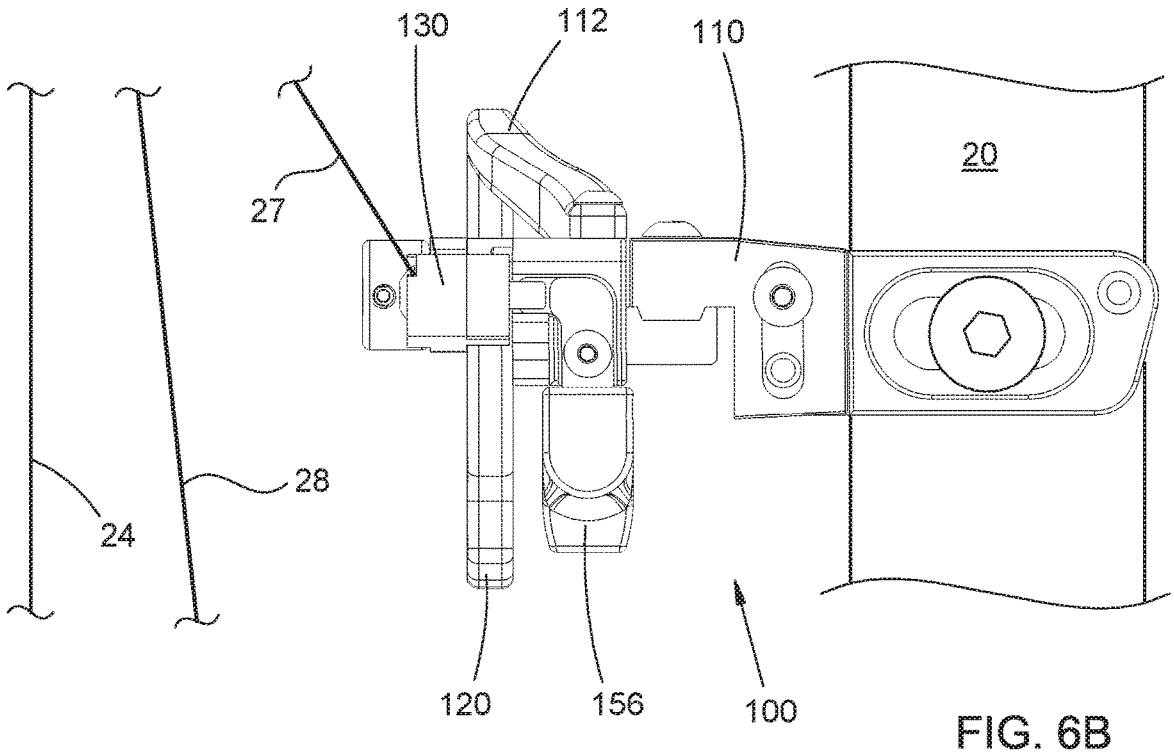
FIG. 6B

FIG. 7A
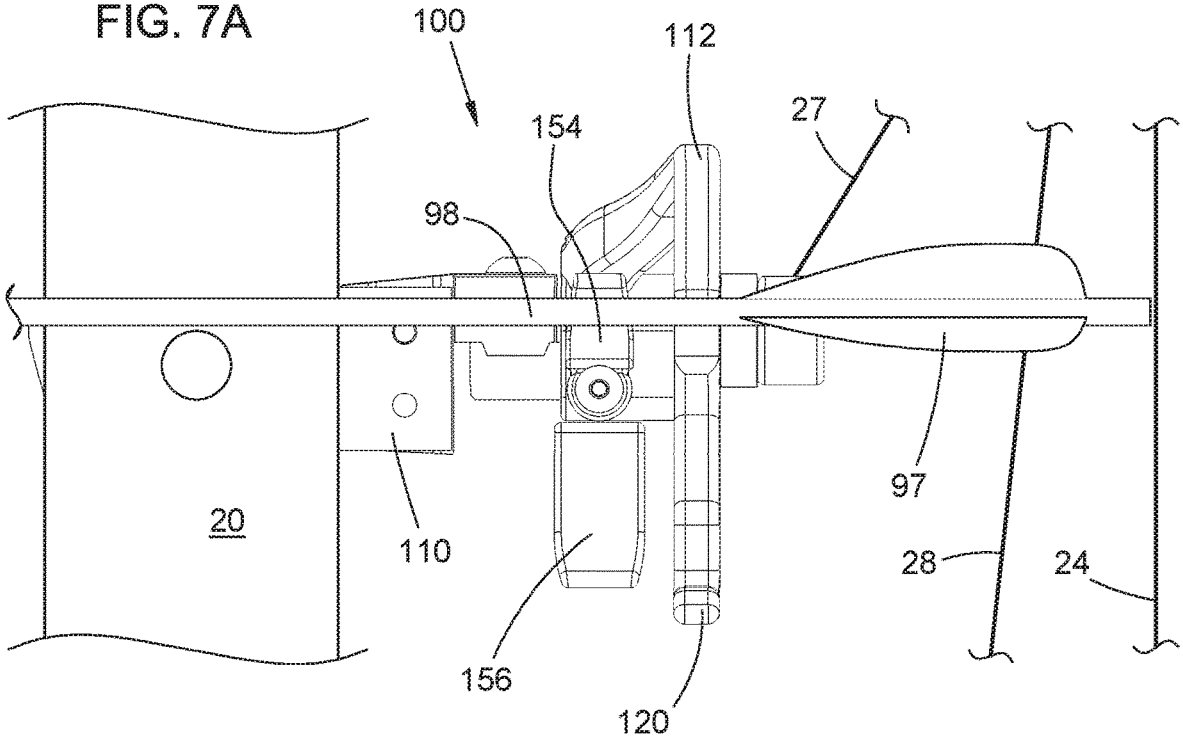
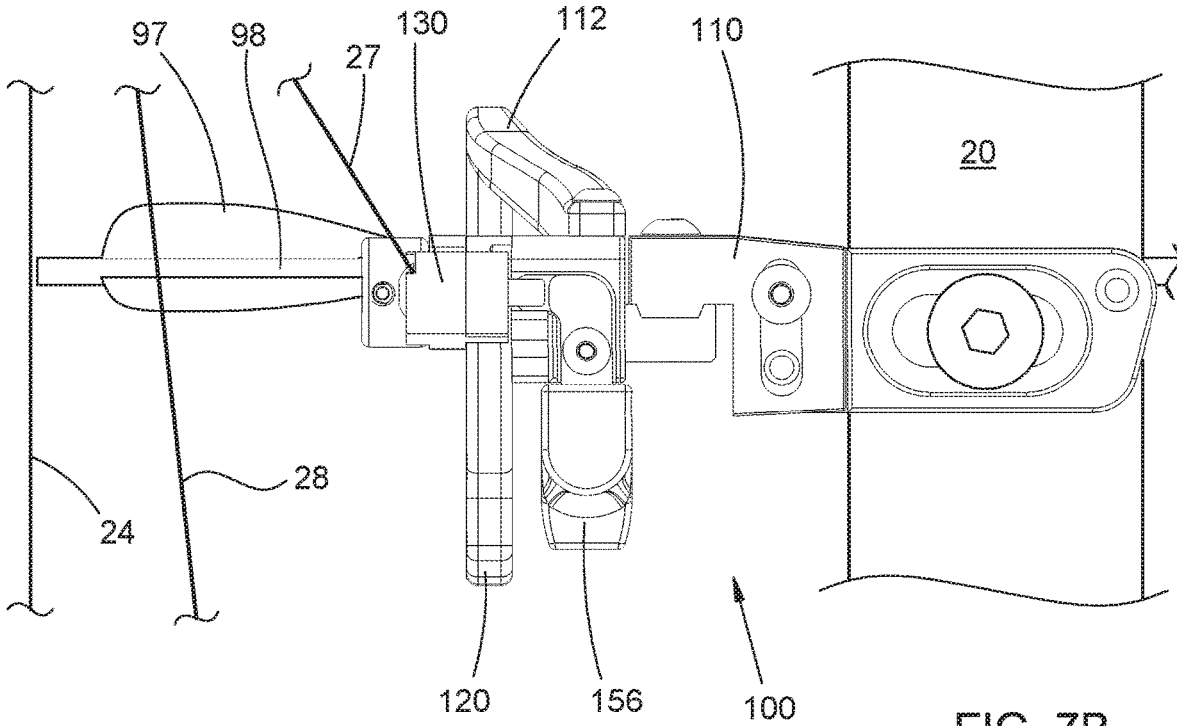
FIG. 7B

FIG. 8A
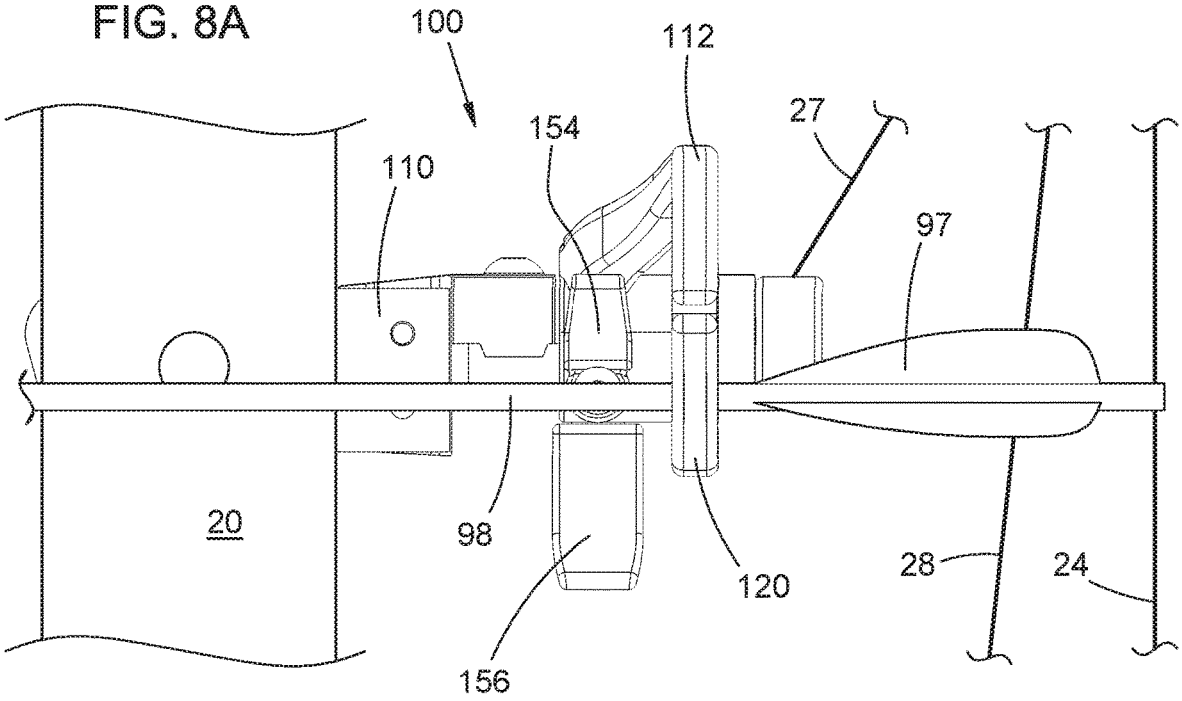
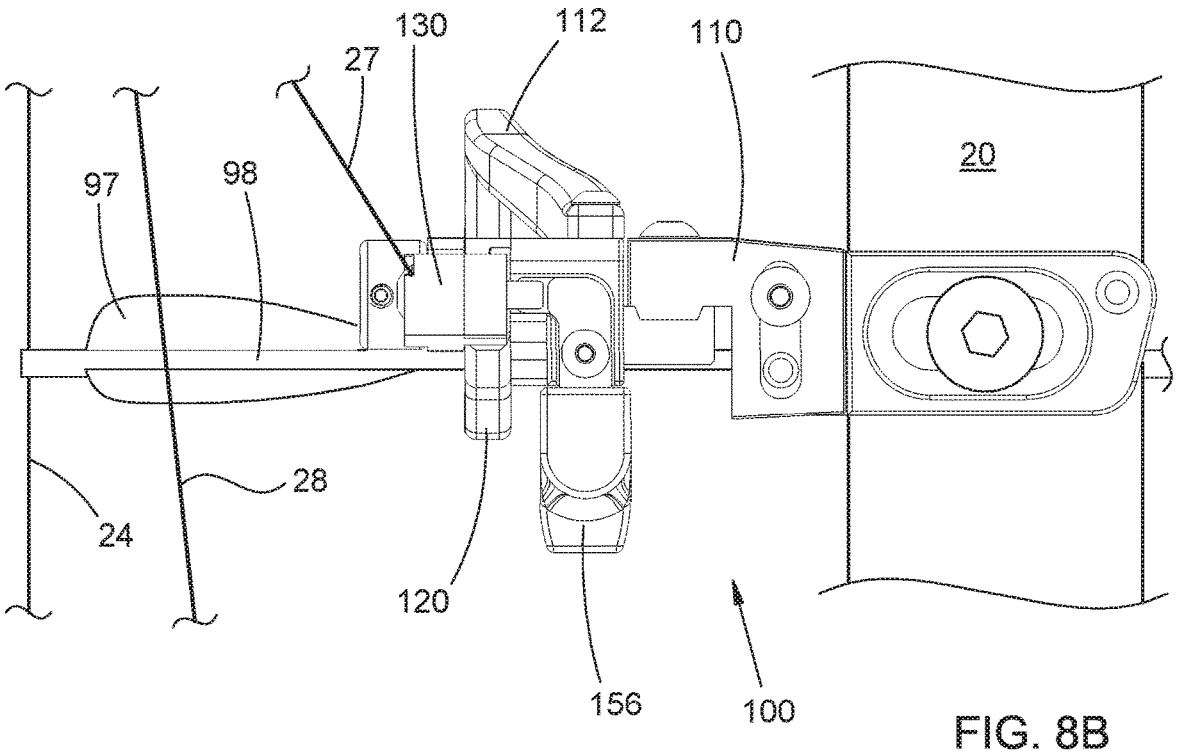
FIG. 8B

FIG. 9A
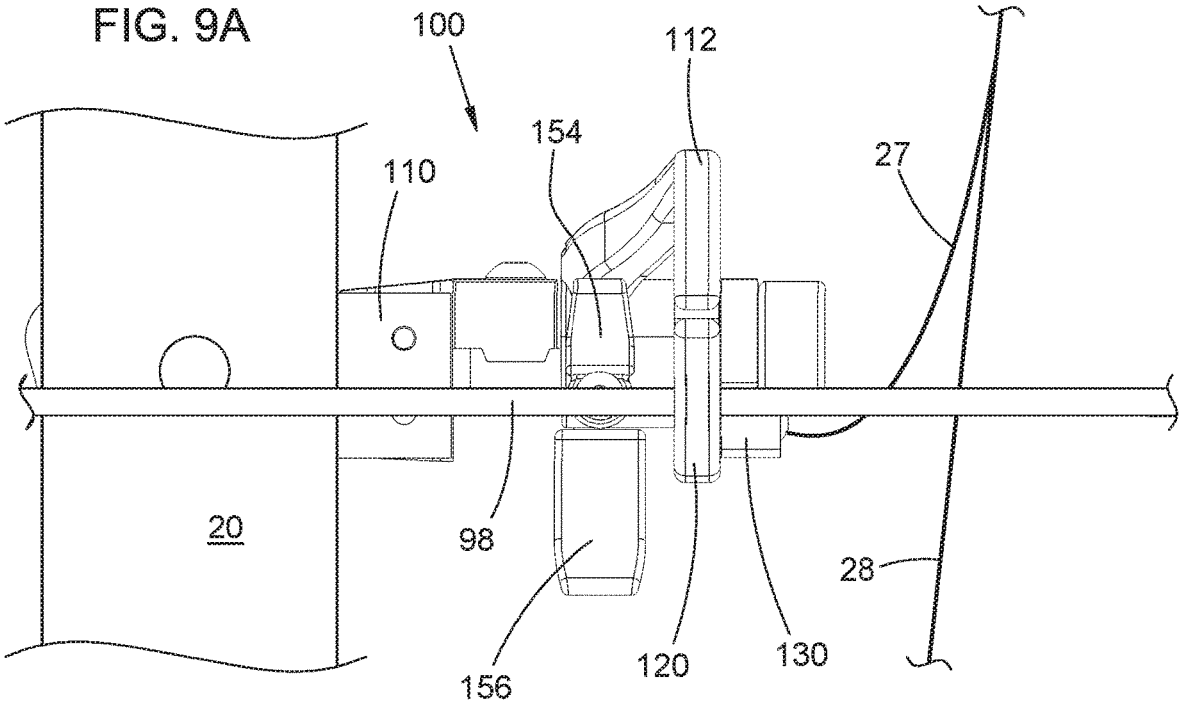
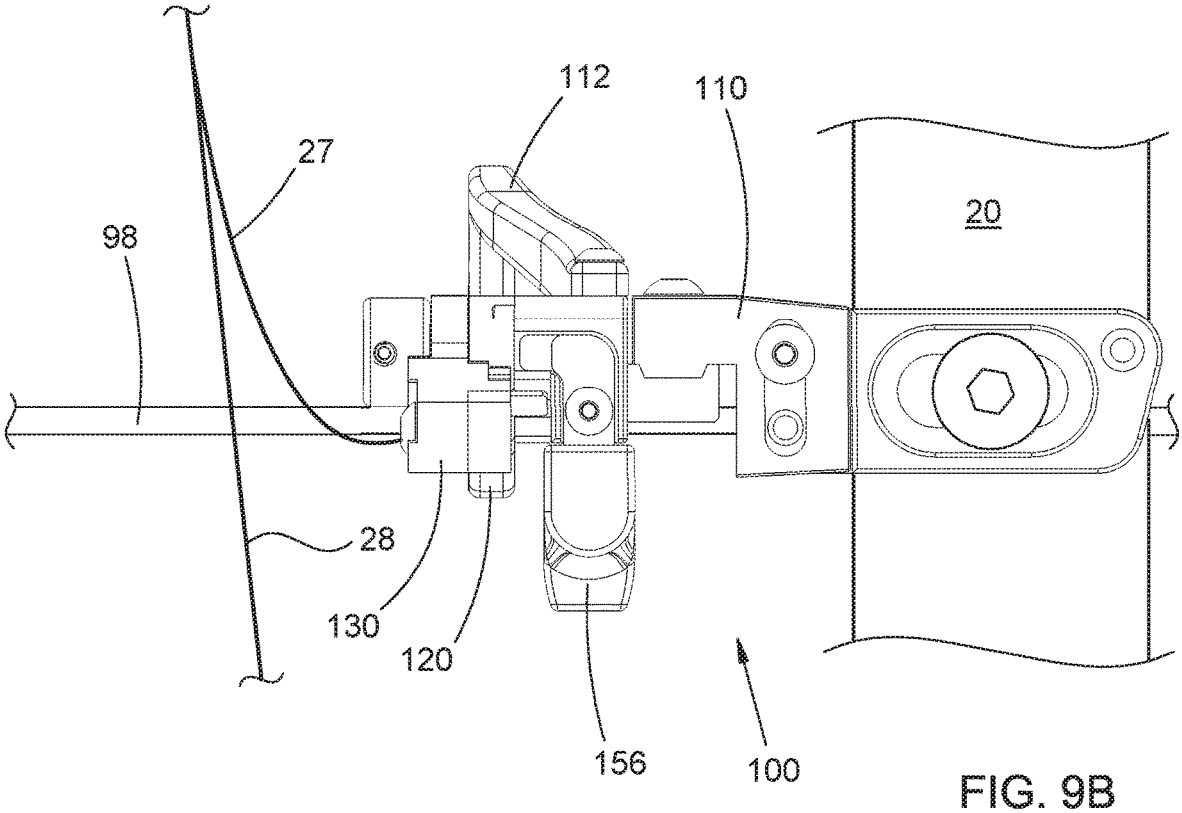
FIG. 9B

ARROW REST ASSEMBLY

FIELD OF THE INVENTION

The field of the present invention relates to arrow rests. In particular, an arrow rest assembly is disclosed herein that includes a launcher that, via a lever, can be selectively coupled to a coupling cable in a limb-driven arrangement, or decoupled from the coupling cable to move to a launcher-up position in response to a bias force. The decoupling can be actuated using the shaft of an arrow nocked or positioned to be nocked.

BACKGROUND

An arrow rest is a structural member attached to an archery bow, typically on the bow's riser or handle, that is arranged to support the shaft of the arrow when the bow is drawn or shot. Such support of the shaft can typically enable the archer to shoot more accurately. Some previous examples of arrow rest assemblies are disclosed in:

- U.S. Pat. No. 3,342,173 entitled "Bow with magnetic retractable arrow rest" issued Sep. 19, 1967 to Ferguson;
- U.S. Pat. No. 4,287,868 entitled "Retracting arrow rest" issued Sep. 8, 1981 to Schiff;
- U.S. Pat. No. 4,473,058 entitled "Arrow rest" issued Sep. 25, 1984 to Terry;
- U.S. Pat. No. 4,489,704 entitled "Archery bow with adjustable arrow support" issued Dec. 25, 1984 to Troncoso;
- U.S. Pat. No. 4,548,189 entitled "Arrow rests used in archery" issued Oct. 22, 1985 to Pietraszek et al;
- U.S. Pat. No. 4,676,220 entitled "Arrow rest" issued Jun. 30, 1987 to Pietraszek;
- U.S. Pat. No. 4,803,971 entitled "Bow-limb-operated pull-down arrow rest support" issued Feb. 14, 1989 to Fletcher;
- U.S. Pat. No. 5,235,958 entitled "Retractable arrow holder" issued Aug. 17, 1993 to Laffin;
- U.S. Pat. No. 5,503,136 entitled "Arrow rest with retracting arm" issued Apr. 2, 1996 to Tone;
- U.S. Pat. No. 6,044,832 entitled "Fallaway arrow rest assembly" issued Apr. 4, 2000 to Piersons;
- U.S. Pat. No. 6,050,251 entitled "Apparatus for adjustably mounting a pivotal arrow rest" issued Apr. 18, 2000 to Harwath et al;
- U.S. Pat. No. 6,082,348 entitled "Arrow west" [sic] issued Jul. 4, 2000 to Savage;
- U.S. Pat. No. 6,102,020 entitled "Slow return arrowrest" [sic] issued Aug. 15, 2000 to Mizek et al;
- U.S. Pat. No. 6,178,959 entitled "Adjustable arrow rest with deflection indicator" issued Jan. 30, 2001 to Troncoso et al;
- U.S. Pat. No. 6,561,174 entitled "Arrow rest" issued May 13, 2003 to Afshari;
- U.S. Pat. No. 6,688,296 entitled "Arrow rest" issued Feb. 10, 2004 to Greywall;
- U.S. Pat. No. 6,688,297 entitled "Magnetic arrow rest biasing device" issued Feb. 10, 2004 to Clague;
- U.S. Pub. No. 2007/0163560 entitled "Adjustable arrow rest apparatus" published Jul. 19, 2007 in the name of Mertens;
- U.S. Pub. No. 2007/0221186 entitled "Drop-away arrow rest" published Sep. 27, 2007 in the names of Grace et al;

- U.S. Pub. No. 2008/0236556 entitled "Fall-away arrow rest" published Oct. 2, 2008 in the names of Sims et al;
- U.S. Pat. No. 7,963,279 entitled "Drop-away arrow rest" issued Jun. 21, 2011 to Harwath et al;
- U.S. Pat. No. 8,544,457 entitled "Archery rest system" issued Oct. 1, 2013 to Munsell et al;
- U.S. Pub. No. 2013/0255654 entitled "Arrow rest" published Oct. 3, 2013 in the name of Nystrom;
- U.S. Pub. No. 2015/0184972 entitled "Drop-away arrow rest" published Jul. 2, 2015 in the names of Grace et al;
- U.S. Pub. No. 2016/0341512 entitled "Magnetic drop-away arrow rest" published Nov. 24, 2016 in the name of Grace; and
- U.S. Pub. No. 2017/0191788 entitled "Arrow rest assembly with bidirectional bias torque" published Jul. 6, 2017 in the name of Eacker.

Many previous examples of arrow rest assemblies employ a "fall-away" design wherein the arrow rest (also referred to as the launcher) is arranged to be in a launcher-up position with the bow drawn and then to move to a launcher-down position after the bowstring is released and the bow returns to its brace configuration. In the launcher-up position, the launcher supports the front end of the nocked arrow with the bow drawn; in the launcher-down position, the launcher can allow the arrow's fletching to pass unimpeded (or at least less impeded) when the bowstring of the drawn bow is released to shoot the arrow. Fall-away arrow rest assemblies fall into "limb-driven" or "cable-driven" categories.

In a limb-driven type of arrow rest assembly, the launcher is biased toward the launcher-up position by a bias mechanism, e.g., a spring or an arrangement of magnets. A coupling cable or tether is connected to one of the bow limbs and to the arrow rest assembly and arranged, with the bow at brace, so that the coupling cable is tensioned and holds the launcher in the launcher-down position against the bias force. Upon drawing the bow, the coupling cable goes slack (due to the bending of the bow limb toward the arrow rest assembly) and the bias force moves the launcher into the launcher-up position to support the arrow. Upon releasing the bowstring to shoot the arrow, the bow limb returns to its brace configuration, reapplying tension to the coupling cable and pulling the launcher back to the launcher-down position against the bias force. Instead of being connected to the bow limb, alternatively the coupling cable can be connected to a segment of a cable of the compound bow that moves toward the arrow rest assembly as the bow is drawn. Such an arrangement behaves the same as if the coupling cable were connected to the bow limb and shall also be referred to as "limb-driven."

In a cable-driven type of arrow rest assembly, the launcher is biased toward the launcher-down position by the bias mechanism. The coupling cable is connected to a segment of a bow cable that moves away from the arrow rest assembly as the bow is drawn. At brace the coupling cable is slack, and the bias force holds the launcher in the launcher-down position. As the bow is drawn, movement of the bow cable tensions the coupling cable and moves the launcher to the launcher-up position against the bias force. Upon releasing the bow string to shoot the arrow, movement of the bow cable allows the coupling cable to go slack, which in turn allows the launcher to return to the launcher-down position in response to the bias force.

SUMMARY

An inventive arrow rest assembly for an archery bow comprises a body, a launcher, a lever, a launcher-lever coupler, and a switch. The body is structurally arranged for attaching the arrow rest assembly to a riser of the bow. The launcher is engaged with the body, movable between a launcher-up position and a launcher-down position, and biased toward the launcher-up position. The lever is engaged with the body, movable between a brace position and a drawn position, and biased toward the drawn position. The launcher-lever coupler is movable between coupled and decoupled arrangements and biased toward the coupled arrangement. With the coupler in the coupled arrangement, the launcher and the lever are constrained to move together in an aligned arrangement; with the coupler in the coupled arrangement and the lever held in the brace position against bias force thereon, the launcher is held in the launcher-down position against bias force thereon; with the coupler in the coupled arrangement and the lever in the drawn position, the launcher is held in the launcher-up position. With the coupler in the decoupled arrangement, the launcher and lever move independently, and the launcher is moved to or held in the launcher-up position by the bias force thereon; with the coupler in the decoupled arrangement, relative motion of the launcher and the lever into the aligned arrangement enables biased movement of the coupler to the coupled arrangement. The switch is arranged so that, with the coupler in the coupled arrangement and the lever held in the brace position against the bias force thereon, manual actuation of the switch results in movement of the coupler to the decoupled arrangement against the bias force thereon and biased movement of the launcher to the launcher-up position. The switch includes an actuator positioned and arranged so that, with the arrow rest assembly attached to the riser of the bow, the switch can be actuated manually by pressing against the actuator a lateral surface of a shaft of an arrow nocked or positioned to be nocked onto a bowstring of the bow. The switch and the coupler can be arranged so that only manual actuation of the switch enables biased movement of the launcher to the launcher-up position with the lever held in the brace position against the bias force thereon.

In some examples the actuator can comprise a paddle attached to the body and positioned so that the switch can be actuated manually by sideways movement, toward the riser against the paddle, of the shaft of the arrow nocked or positioned to be nocked onto the bowstring of the bow. In some examples, the actuator can comprise a containment arm attached to the body and positioned so that the switch can be actuated manually by upward movement, against the containment arm, of the shaft of the arrow nocked or positioned to be nocked onto the bowstring of the bow. In some examples the switch can further include a button or a switch lever attached to the body and positioned so that the switch can be actuated manually by pressing the button or the switch lever, e.g., with one's finger or thumb.

The arrow rest assembly can further include a coupling cable attached to the lever and to the bow. The coupling cable can be arranged so that, with the arrow rest assembly attached to the bow, (i) with the bow at brace, tension on the coupling cable holds the lever in the brace position against the bias force thereon, and (ii) with the bow drawn, lack of tension on the coupling cable enables biased movement of the lever to the drawn position. The arrow rest assembly can be further arranged so that, with the arrow rest assembly attached to the bow, (i) with the bow at brace and the coupler in the coupled arrangement, tension on the coupling cable holds the launcher in launcher-down position against the bias force thereon, (ii) with the bow at brace, actuation of the switch moves the coupler to the decoupled arrangement against the bias force thereon and thereby enables biased movement of the launcher to the launcher-up position, (iii) with the bow drawn, the lever in the drawn position, and the launcher in the launcher-up position, the aligned arrangement of the lever and the launcher enables biased movement of the coupler to the coupled arrangement, and (iv) with the coupler in the coupled arrangement, return of the drawn bow to brace results in restored tension on the coupling cable, movement of the lever to the brace position against the bias force thereon, and movement of the launcher to the launcher-down position against the bias force thereon.

Objects and advantages pertaining to arrow rests may become apparent upon referring to the example embodiments illustrated in the drawings and disclosed in the following written description or appended claims.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

BRIEF DESCRIPTION OF THE DRAWINGS

FIGS. 1A through 1D are rear perspective, rear, top cross-sectional, and rear cross-sectional views, respectively, of an example inventive arrow rest assembly in a first stage of its operation.

FIGS. 2A through 2D are rear perspective, rear, top cross-sectional, and rear cross-sectional views, respectively, of an example inventive arrow rest assembly in a second stage of its operation.

FIGS. 3A through 3D are rear perspective, rear, top cross-sectional, and rear cross-sectional views, respectively, of an example inventive arrow rest assembly in a third stage of its operation.

FIGS. 4A through 4D are rear perspective, rear, top cross-sectional, and rear cross-sectional views, respectively, of an example inventive arrow rest assembly in a fourth stage of its operation.

FIGS. 6A and 6B are left and right side views, respectively, of an example inventive arrow rest assembly in a first stage of its operation and attached to a compound archery bow.

FIGS. 7A and 7B are left and right side views, respectively, of an example inventive arrow rest assembly in a first stage of its operation and attached to a compound archery bow, with an arrow in position to actuate the switch.

FIGS. 8A and 8B are left and right side views, respectively, of an example inventive arrow rest assembly in a third stage of its operation and attached to a compound archery bow, with an arrow nocked onto the bowstring and resting on the launcher.

FIGS. 9A and 9B are left and right side views, respectively, of an example inventive arrow rest assembly in a fourth stage of its operation and attached to a compound archery bow, with the bow drawn and the arrow resting on the launcher.

The embodiments depicted are shown only schematically; all features may not be shown in full detail or in proper proportion; for clarity certain features or structures may be exaggerated or diminished relative to others or omitted entirely; the drawings should not be regarded as being to scale unless explicitly indicated as being to scale. The embodiments shown are only examples and should not be construed as limiting the scope of the present disclosure or appended claims.

DETAILED DESCRIPTION OF EMBODIMENTS

Figure 10A:
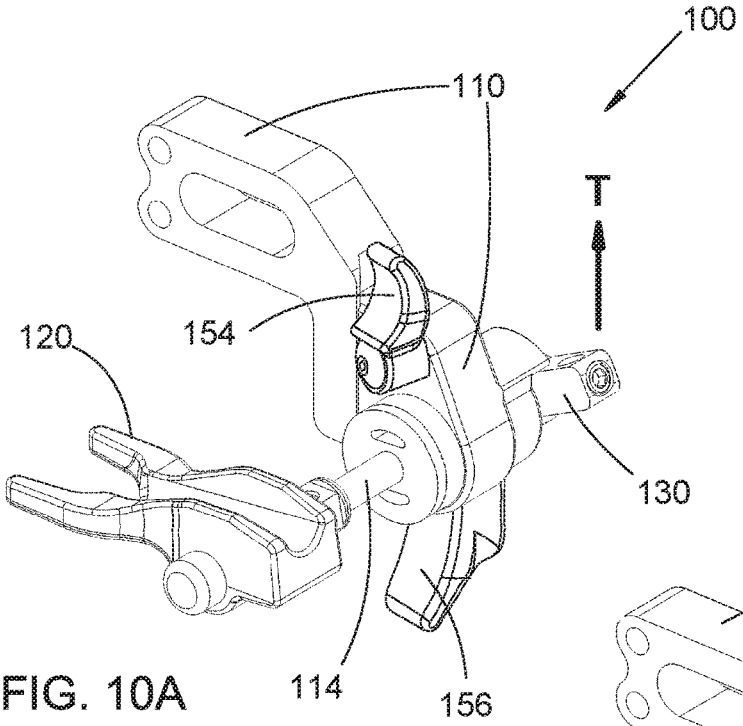
FIGS. 10A through 10C are rear perspective views of another example inventive arrow rest assembly in its first, third, and fourth stages of operation, respectively.
Figure 10B:
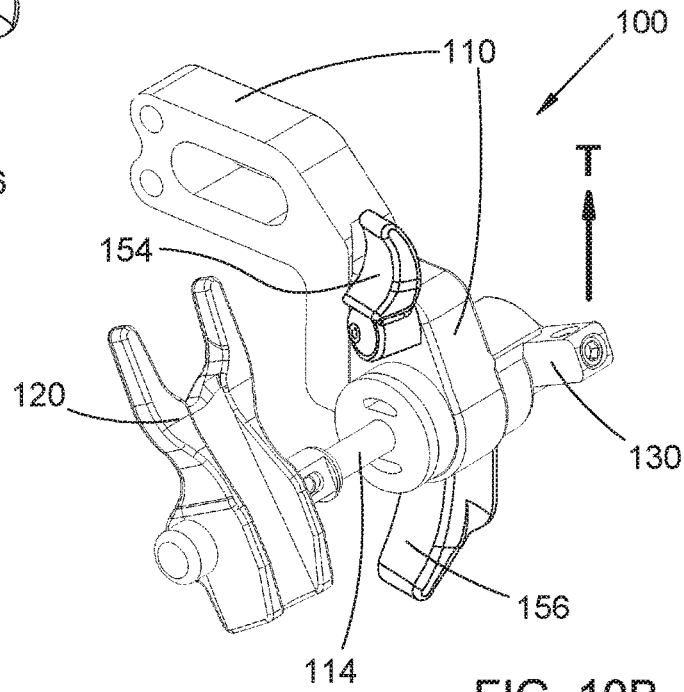
Figure 10C:
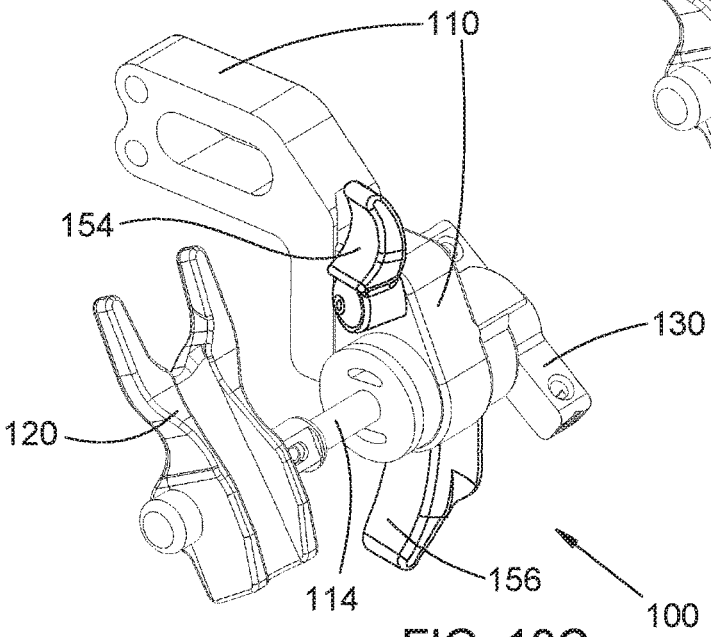

An example of an inventive arrow rest assembly 100 is shown in FIGS. 1A through 9B. A second example of an inventive arrow rest assembly 100 is shown in FIGS. 10A through 10C. The arrow rest assembly 100 comprises a body 110, a launcher 120, a lever 130, a launcher-lever coupler, and a switch. The body 110 is structurally arranged in any suitable way for attaching the arrow rest assembly 100 to a riser 20 of an archery bow. In some examples the body 110 can include adjustment mechanisms for enabling vertical adjustment (i.e., elevation or range adjustment) or horizontal adjustment (i.e., windage adjustment); any one or more suitable adjustment mechanisms can be employed. The launcher 120 is engaged with the body 110, movable between a launcher-up position and a launcher-down position, and biased toward the launcher-up position. Any suitable bias mechanism can be employed for biasing the launcher 120 toward its launcher-up position, e.g., one or more tension, compression, or torsion springs, one or more magnets, or other suitable bias mechanism; a torsion spring 122 is employed in the example of FIGS. 1A through 9B. The lever 130 is engaged with the body 110, movable between a brace position and a drawn position, and biased toward the drawn position. Any suitable bias mechanism can be employed for biasing the lever 130 toward its drawn position, e.g., one or more tension, compression, or torsion springs, a set of two or more magnets, or other suitable bias mechanism; a torsion spring 132 is employed in the example of FIGS. 1A through 9B. In some examples, movement of one or both of the launcher 120 or the lever 130 can be limited by one or more stops arranged in any suitable way. Such a stop can be advantageously employed, e.g., for preventing movement of the launcher 120 beyond the launcher-up position as it moves away from its launcher-down position; use of such a stop can ensure consistent positioning of an arrow resting on the launcher 120 as the bow is drawn and then shot.

In some examples, including the examples shown in the drawings, the arrow rest assembly 100 can include a shaft 114 engaged with the body 110 that defines an arrow rest rotation axis. In such examples the launcher 120 is engaged with the body 110 by engagement with the shaft 114 and is rotatable about the axis between the launcher-up and launcher-down positions. Similarly, in such examples the lever 130 is engaged with the body 110 by engagement with the shaft 114 and is rotatable about the axis between the brace and drawn positions. In examples including a shaft 114, the shaft can be non-rotatably engaged with any one, or none, of the body 110, launcher 120, or lever 130. In some examples, including the example shown in FIGS. 1A through 9B, with the arrow rest assembly 100 attached to the riser 20 of the bow (e.g., as in FIGS. 5A/5B), the rotation axis is substantially parallel to a shaft 98 of an arrow nocked on a bowstring 24 of the bow and ready to be shot from bow. In some examples, including the example shown in FIGS. 10A through 10C, with the arrow rest assembly 100 attached to the riser 20 of the bow, the rotation axis is substantially perpendicular to a shooting plane defined by the drawn bowstring 24 of the bow. In still other examples (not shown), the arrow rest assembly 100 can be arranged for curvilinear movement (i.e., translational movement) of the launcher 120 between its launcher-down and launcher-up positions or of the lever 130 between its brace and drawn positions. The launcher 120 can be arranged in any suitable way for supporting the shaft 98 of an arrow to be shot from the bow. In some examples (e.g., as in FIGS. 1A-9B) the launcher includes a transverse arm that can include, e.g., a V- or U-shaped portion (e.g., as in FIGS. 1A-9B), prongs, a fork, a notch, or a groove; rotation of the launcher 120 about the axis from the launcher-up position to the launcher-down position causes the transverse arm to move downward away from the shaft 98 of the arrow. In some other examples (e.g., as in FIGS. 10A-10C) a proximal end of the launcher 120 is engaged with the shaft 114 and a distal end can include, e.g., a V- or U-shaped portion, prongs, a fork (e.g., as in FIGS. 10A-10C), a notch, or a groove; rotation of the launcher 120 about the axis from the launcher-up position to the launcher-down position causes the distal end of the launcher 120 to move downward away from the shaft 98 of the arrow.

The launcher-lever coupler is movable between coupled and decoupled arrangements and biased toward the coupled arrangement. Any suitable bias mechanism can be employed, e.g., one or more tension, compression, or torsion springs, one or more magnets, or other suitable bias mechanism. With the coupler in the coupled arrangement (e.g., as in FIGS. 1A-1D, 4A-4D, 6A, 6B, 7A, 7B, 9A, 9B, 10A, and 10C), the launcher 120 and the lever 130 are constrained to move together in an aligned arrangement; in the examples shown in the drawings, the coupled launcher 120 and lever 130 are constrained to rotate together about the axis. With the launcher 120 and the lever 130 thus coupled and in the aligned arrangement, the launcher-up position of the launcher 120 corresponds to the drawn position of the lever 130, and the launcher-down position of the launcher 120 corresponds to the brace position of the lever 130. With the coupler in the coupled arrangement and the lever 130 held in the brace position against its bias force (e.g., as in FIGS. 1A-1D, 6A, 6B, 7A, 7B, and 10A), the launcher 120 is also held in the launcher-down position against its bias force. With the coupler in the coupled arrangement and the lever 130 in the drawn position (e.g., as in FIGS. 4A-4D, 9A, 9B, and 10C), the launcher 120 is held in the launcher-up position, by both its bias force as well as by the bias force on the lever 130. With the coupler in the decoupled arrangement (e.g., as in FIGS. 2A-2D, 3A-3D, 8A, 8B, and 10B), the launcher 120 and the lever 130 move independently and the launcher is moved to or held in the launcher-up position by its bias force; in the examples shown in the drawings, the decoupled launcher 120 and lever 130 rotate independently about the axis. With the coupler in the decoupled arrangement, relative motion of the launcher 120 and the lever 130 into the aligned arrangement enables biased movement of the coupler to the coupled arrangement (e.g., as in transitions from FIGS. 3A-3D to 4A-4D, FIGS. 8A/8B to 9A/9B, or FIG. 10B to 10C).

With the coupler in the coupled arrangement and the lever 130 held in the brace position against its bias force (e.g., as in FIGS. 1A-1D, 6A, 6B, 7A, 7B, and 10A), manual actuation of the switch moves the coupler to the decoupled arrangement against its bias force, thereby allowing biased movement of the launcher 120 to the launcher-up position (e.g., as in transitions from FIGS. 1A-1D to 2A-2D, FIGS. 7A/7B to 8A/8B, or FIG. 10A to 10B). The switch includes one or more actuators (e.g., paddle 154, button 156, or upper containment arm 112 in the examples shown). At least one actuator (e.g., paddle 154 or upper containment arm 112 in the examples shown) is positioned and arranged so that, with the arrow rest assembly 100 attached to the riser 20 of the bow, the switch can be actuated manually by pressing against that actuator a lateral surface of a shaft 98 of an arrow nocked or positioned to be nocked onto a bowstring 24 of the bow. The switch and the coupler can be arranged so that only manual actuation of the switch enables biased movement of the launcher 120 to the launcher-up position while the lever 130 is held in the brace position against its bias force. In other words, there is no automatic movement of the launcher 120 to the launcher-up position with the bow at brace. In some examples the switch can include as an actuator the paddle 154 attached to the body 110. The paddle 154 can be positioned so that the switch can be actuated manually by sideways movement, toward the riser 20 against the paddle 154, of the shaft 98 of the arrow positioned to be nocked onto the bowstring 24 of the bow (e.g., as in FIGS. 7A/7B) or already nocked onto the bowstring 24. In some examples the switch can include as an actuator the upper containment arm 112 attached to the body 110. The upper containment arm 112 can be positioned so that the switch can be actuated manually by upward movement, against the upper containment arm 112, of the shaft 98 of the arrow nocked or positioned to be nocked onto the bowstring 24 of the bow. Note that in examples wherein the upper containment arm 112 (if present) does not act as an actuator for the switch, it can be substantially rigidly attached to the body 110. The switch can include as an additional actuator a button 156 or a switch lever attached to the body 110. The button 156 can be positioned so that the switch can be actuated manually by pressing the button 156, e.g., with a finger or thumb of the user's hand holding the riser 20 of the bow. Other suitable positions or arrangements can be employed for an additional actuator of the switch.

Any suitable arrangement can be employed for the launcher-lever coupler. Various examples can include, e.g., one or more pins, holes, splines, gears, teeth, tabs, slots, a clutch, and so forth that when engaged (i.e., with the coupler in its coupled arrangement) constrain the coupled launcher 120 and lever 130 to move together. Various examples also include any suitable arrangement that enables disengagement of those one or more pins, holes, splines, gears, teeth, tabs, slots, clutch, and so forth (i.e., to move the coupler to its decoupled arrangement) to allow independent movement of the decoupled launcher 120 and lever 130. The coupler is biased in any suitable way (e.g., one or more springs, one or more magnets, and so forth) toward its coupled arrangement (i.e., the one or more pins, holes, splines, gears, teeth, tabs, slots, clutch, and so forth are biased toward engagement).

In the example of FIGS. 1A through 9B, the coupler includes a biased pin 144 and a mating hole 142. In some examples (including the one shown) the biased pin 144 can be in the lever 130 and the mating hole 142 can be in the launcher 120; in other examples the biased pin 144 can be in the launcher 120 and the mating hole 142 can be in the lever 130. With the lever 130 and the launcher 120 in the aligned arrangement (e.g., as in FIGS. 1C/1D and 4C/4D), the hole 142 is aligned with the pin 144 so as to enable the pin 144 to engage the hole 142 in response to bias force on the pin 144 (spring-loaded toward engagement with the hole 142 in the example shown). With the arrow rest assembly 100 in the arrangement of FIGS. 1C/1D, actuation of the switch retracts the pin 144 from the hole 142 against the bias force on the pin 144, disengages the pin 144 from the hole 142, and enables biased movement of the launcher 120 to the launcher-up position. In other words, actuation of the switch enables the arrow rest assembly 100 to transition from the arrangement of FIGS. 1C/1D to the arrangement of FIGS. 2C/2D or 3C/3D. Once decoupled, and with the launcher 120 in the launcher-up position (e.g., as in FIGS. 3C/3D), movement of the lever 130 from the brace position to the drawn position aligns the pin 144 with the hole 142, thereby enabling the pin 144 to engage the hole 142 in response to its bias force, returning the coupler to the coupled arrangement (i.e., allowing the arrow rest assembly 100 to transition from the arrangement of FIGS. 3C/3D to the arrangement of FIGS. 4C/4D).

In some examples, including the example of FIGS. 1A-9B, the paddle 154 is attached to a reciprocating member 152 engaged with the body 110. A transverse flange 158 is attached to the reciprocating member 152. Sideways movement, toward the riser 20 against the paddle 154, of a shaft 98 of an arrow nocked on a bowstring 24 of the bow, moves the reciprocating member 152 and the flange 158. The flange 158 in turn pushes against a mating transverse flange 146 attached to the pin 144 and retracts the pin 144 from the hole 142 against the bias force on the pin 144 (see FIGS. 1C, 2C, and 3C). The button 156 (if present) can also be attached to the reciprocating member 152. Instead of a reciprocating member 152, in other examples a coupler lever of any suitable arrangement can be employed for transmitting movement of the paddle 154 (or button 156, if present) to the pin 144. Instead of the paddle 154, in other examples the upper containment arm 112 can be arranged to retract the pin 144 from the hole 142 when pressed upward by the shaft 98 of an arrow.

Figure 1A:
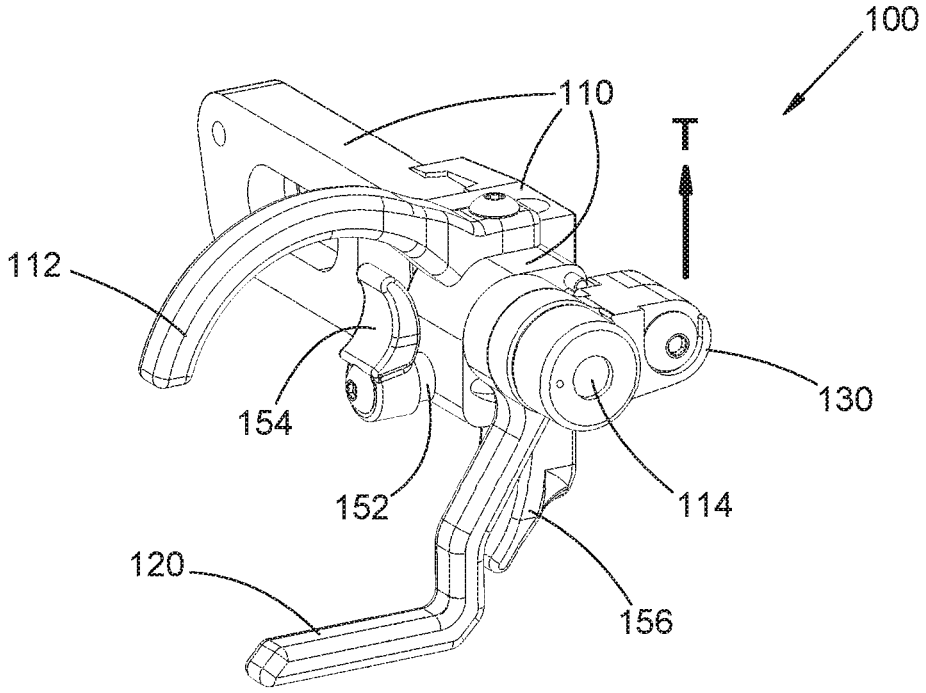
Figure 1B:
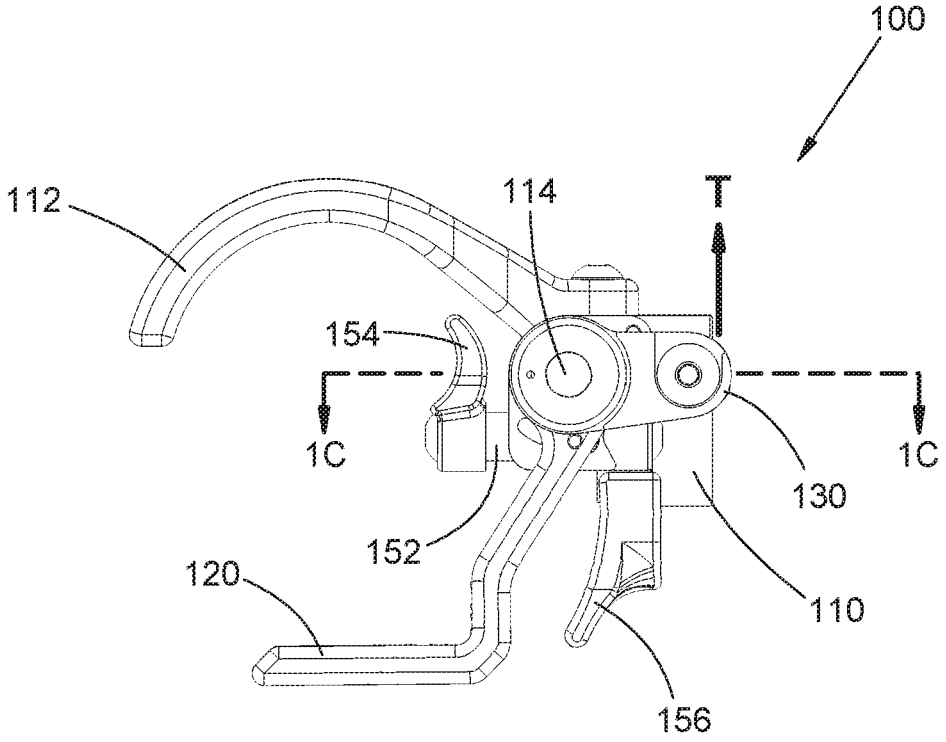
Figure 2A:
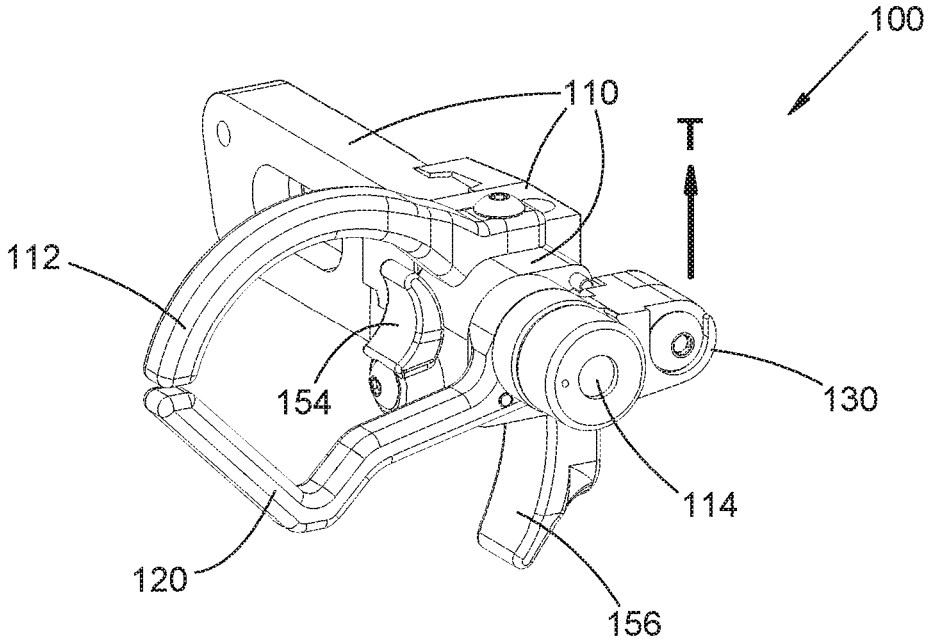
Figure 2B:
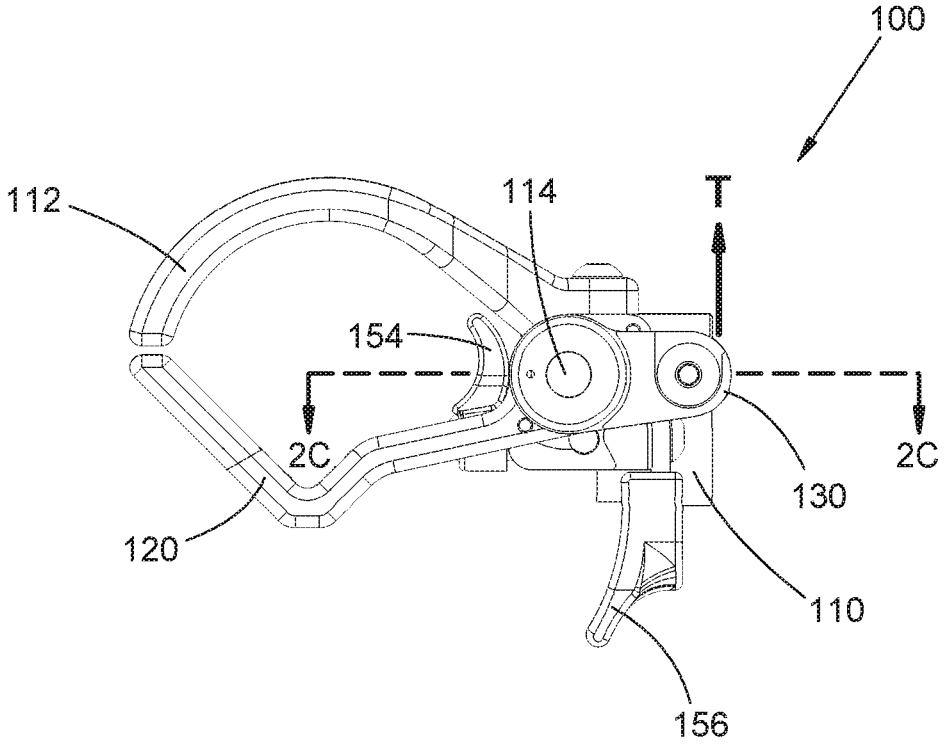
Figure 3A:
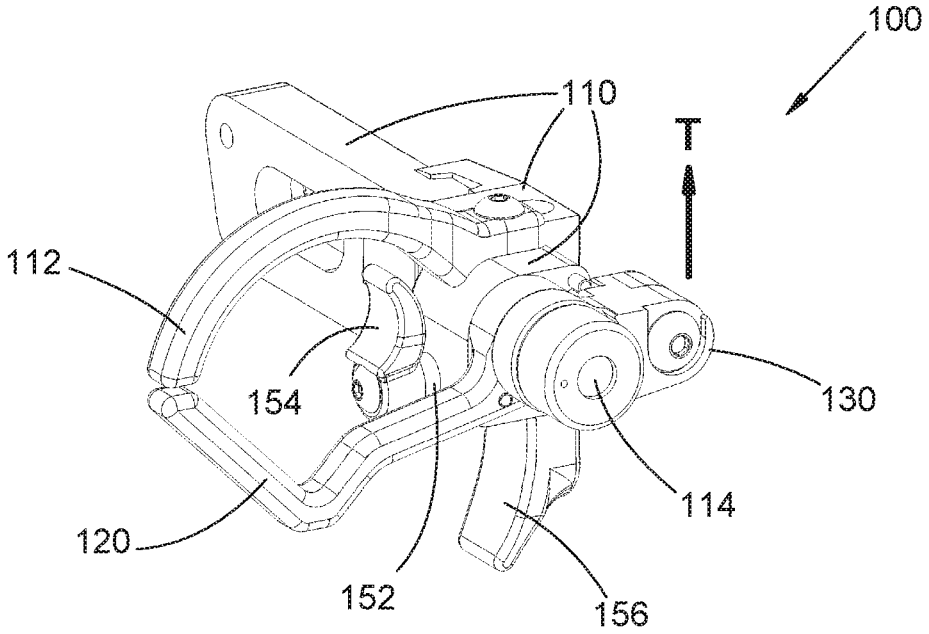
Figure 3B:
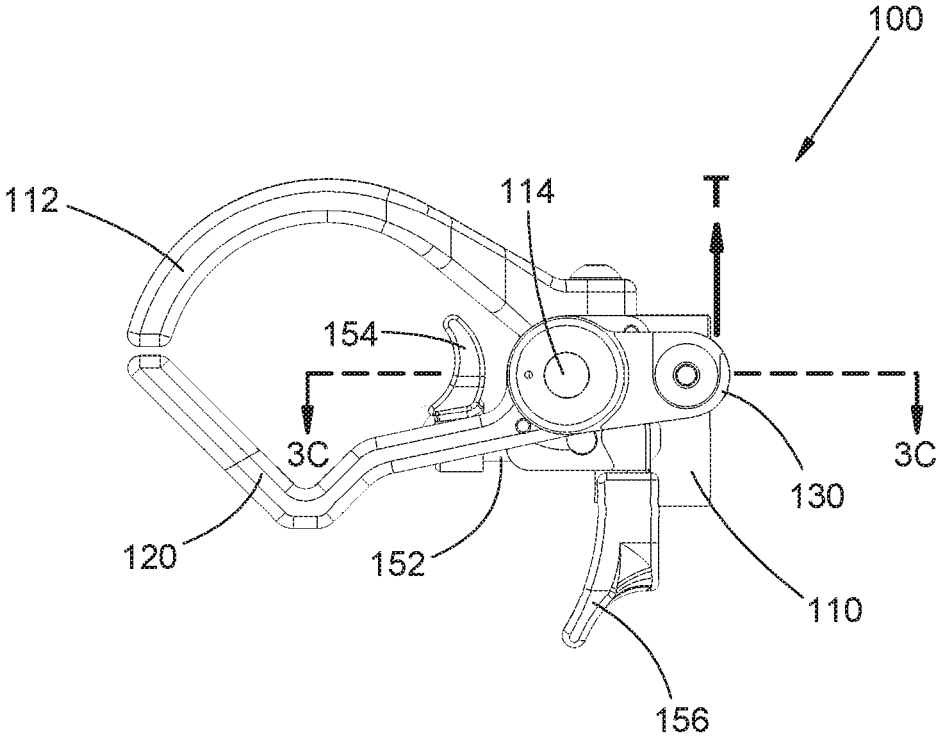
Figure 4A:
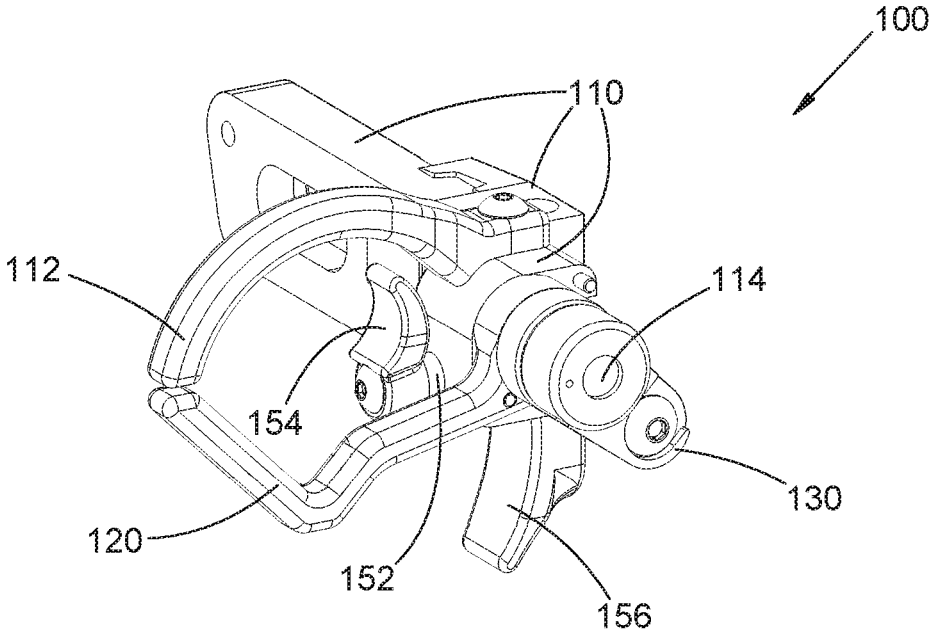
Figure 4B:
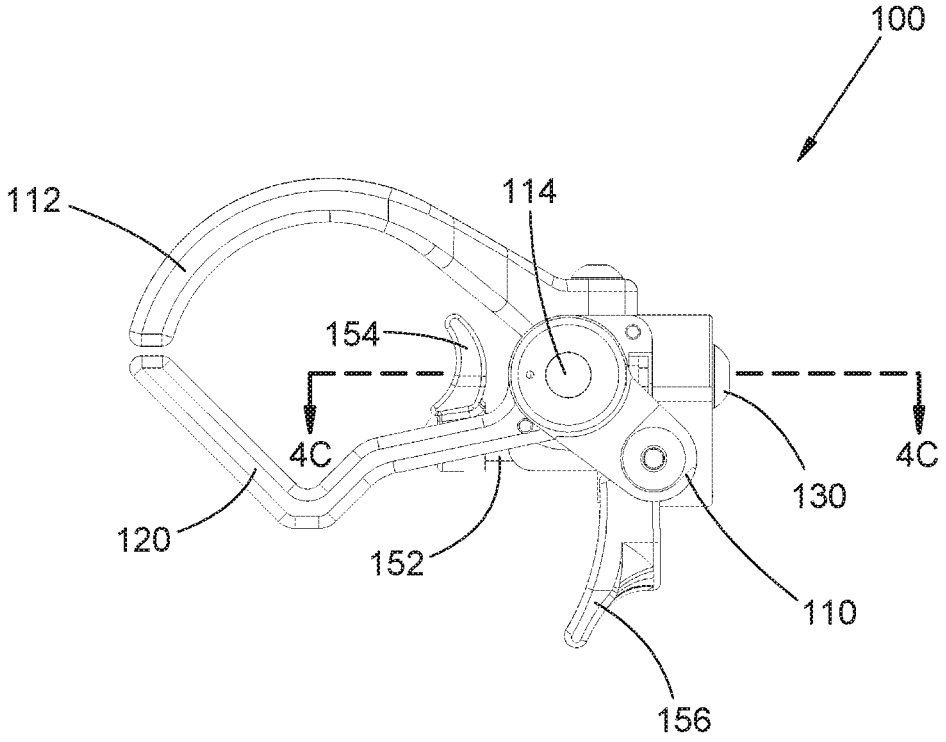
Figure 5A:
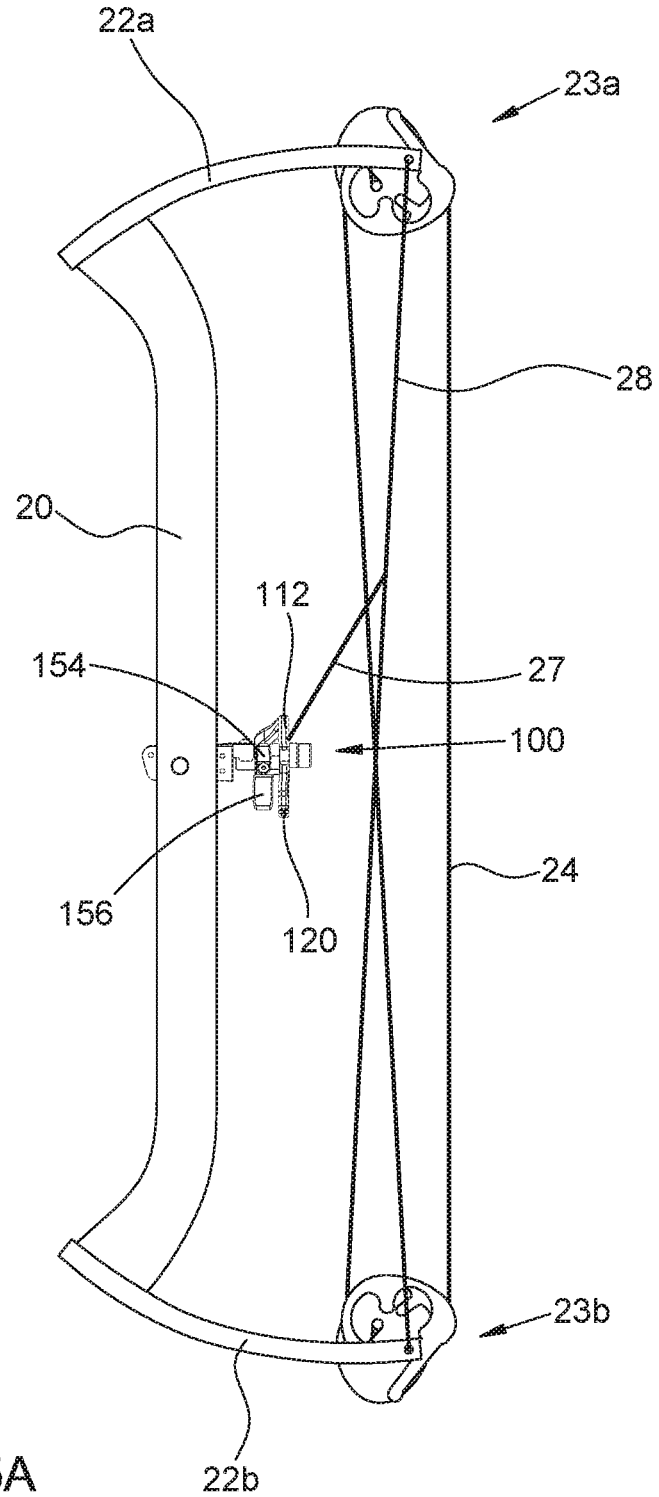
FIGS. 5A and 5B show an example inventive arrow rest assembly mounted on dual-cam and solo-cam compound archery bows, respectively.
Figure 5B:
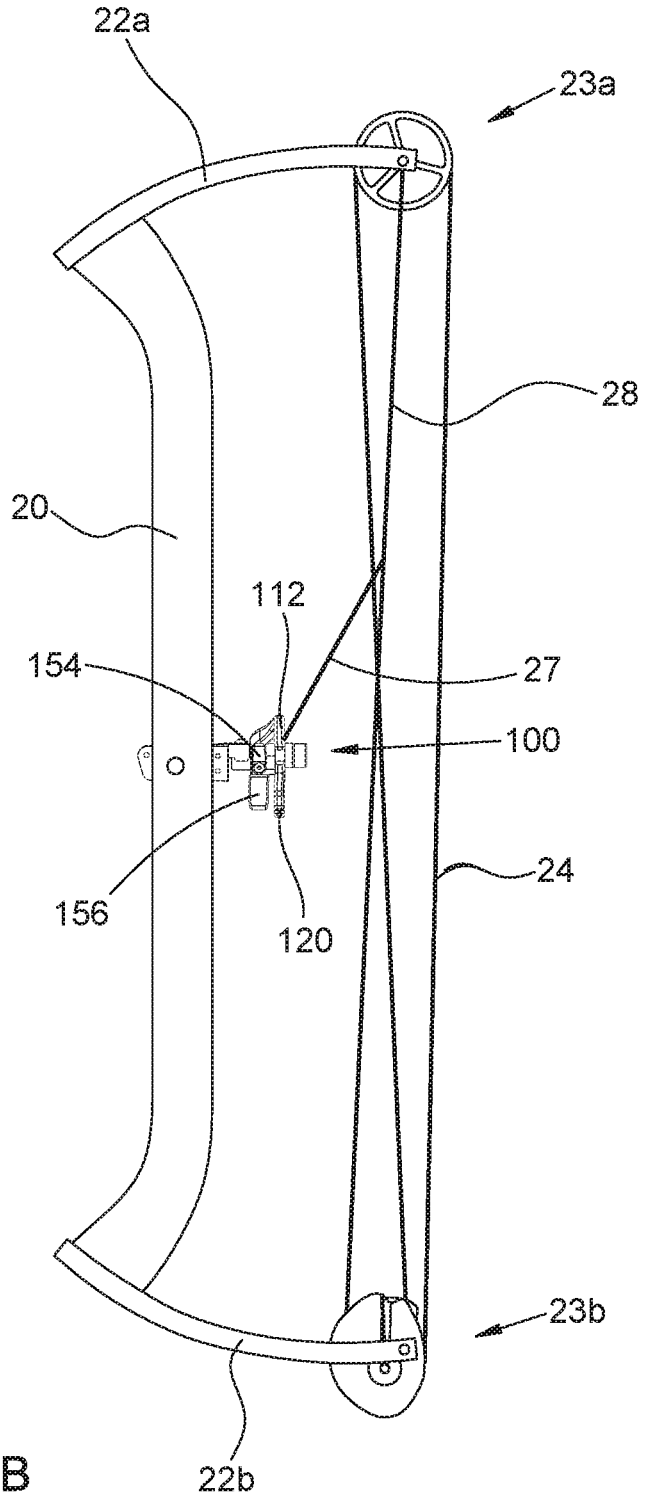

When mounted on a compound bow (e.g., as in FIG. 5A or 5B), the arrow rest assembly 100 can further include a coupling cable 27 attached to the lever 130 and to the bow. The coupling cable 27 is attached to some component of the bow that moves toward the arrow rest assembly 100 when the bow is drawn, such as a limb 22*a* or 22*b* or an axle, a segment of a power cable 28 of a dual, binary, solo, or hybrid cam bow, a segment of a let-out cable of a solo cam bow, or a segment of a coupling cable of a hybrid cam bow. Accordingly, with the bow at brace the coupling cable 27 is under tension (indicated by the arrow labelled T in the drawings) and holds the lever 130 in its brace position against its bias force, and when the bow is drawn the coupling cable 27 goes slack and allows the lever to move to the drawn position in response to its bias force. When the bow is shot and returns to brace, tension is restored on the coupling cable 27, which moves the lever 130 back to its brace position against its bias force and also moves the coupled launcher 120 to its launcher-down position against its bias (e.g., effecting a transition from FIGS. 4A-4D to FIGS. 1A-1D, FIGS. 9A/9B to FIGS. 6A/6B, or FIG. 10C to 10A). In FIG. 5A the coupling cable 27 is connected to segment of a power cable 28 of a dual cam bow; in FIG. 5B the coupling cable 27 is connected to a segment of a power cable 28 of a solo cam bow. Other suitable connections can be employed for the coupling cable 27. The inventive arrow rest assembly 100 can attached to and used with any dual, binary, solo, or hybrid cam bow.

In each of the examples shown, the launcher 120 and the attachment of the coupling cable 27 to the lever 130 form a first class lever (fulcrum between effort and load, which move in opposite directions), so that upward movement of the coupling cable 27 is needed to effect downward movement of the launcher 120. Accordingly, in such examples the coupling cable 27 should be connected above the arrow rest assembly 100 to the upper limb 22*a* or a cable segment that moves downward when the bow is drawn and upward when the bow is shot and returns to brace, as shown in the examples of the drawings. In other examples (not shown) the launcher 120 and the attachment of the coupling cable 27 to the lever 130 form a second or third class lever (load and effort on the same side of the fulcrum, and so move in the same direction), so that downward movement of the coupling cable 27 is needed to effect downward movement of the launcher 120. Accordingly, in such examples the coupling cable 27 should be connected below the arrow rest assembly 100 to the lower limb 22*b* or a cable segment that moves upward when the bow is drawn and downward when the bow is shot and returns to brace. Both types of arrangements fall within the scope of the present description or appended claims.

The sequence arrangements of the arrow rest assembly 100 shown in the drawings will now be described in detail. FIGS. 1A-1D and 6A/6B illustrate a first stage of operation of the arrow rest assembly 100 after a previous arrow was shot, but before preparations for the next shot have begun. The bow is at brace, the coupling cable 27 is under tension, and tension on the coupling cable 27 holds the lever 130 in its brace position against its bias force. The coupler is in its coupled arrangement (i.e., the pin 144 is align with and engaged with the hole 142), the launcher 120 and the lever 130 are in the aligned arrangement, and the launcher 120 is held in its launcher-down position against its bias force. A user then positions an arrow to be nocked onto the bowstring 24 for the next shot, as illustrated in FIGS. 7A/7B. The user uses the shaft 98 of the arrow to push the paddle 154 sideways toward the riser 20, actuating the switch, before or after nocking the arrow onto the bowstring 24. Alternatively, the user could use a finger or thumb to actuate the switch using the button 156. Actuation of the switch moves the coupler to its decoupled arrangement (i.e., retracts the pin 144 from the hole 142 against bias force on the pin 144) and allows the launcher 120 to move to the launcher-up position in response to its bias force. The resulting second stage of operation of the arrow rest assembly is illustrated in FIGS. 2A-2D. A third stage of operation is illustrated in FIGS. 3A-3D and 8A/8B, in which the shaft 98 of the nocked arrow is be placed on the launcher 120. In the examples shown, arrangement of the arrow rest assembly 100 in the second and third stages of operation differ only in that, in the third stage arrangement, the pin 144 moves in response to its bias against the launcher 120 (but not aligned with the hole 142) and the reciprocating member 152, paddle 154, and button 156 return to their pre-actuation positions.

At the third stage of operation, the bow is ready to be drawn. Drawing the bow causes the coupling cable 27 to go slack and allows the lever 130 to move to its drawn position in response to its bias force. Upon the lever 130 reaching the aligned arrangement with the launcher 120 (held in its launcher-up position by its bias force), the coupler returns to its coupled arrangement in response to its bias force (i.e., upon alignment with the hole 142, the pin 144 engages the hole 142 in response to its bias force). The resulting fourth stage of operation is illustrated in FIGS. 4A-4D and 9A/9B. The bow is drawn, the coupling cable 27 is slack, and the lever 130 is held in its drawn position by its bias force. The coupler is in its coupled arrangement, the launcher 120 and the lever 130 are in the aligned arrangement, and the launcher 120 is held in its launcher-up position by its bias force and by the bias force on the coupled lever 130. The arrow is ready to be shot from the bow. Upon release of the bowstring 24 to shoot the arrow from the bow, tension is restored on the coupling cable 27. Tension on the coupling cable 27 moves the lever 130 to its brace position against its bias force and moves the coupled launcher 120 to its launcher-down position against its bias force. Downward movement of the launcher 120 as the bow is shot can enable the fletching 97 of the arrow to clear the launcher 120 as the arrow leaves the bow. Shooting the bow results in the arrow rest assembly 100 returning to the first stage of operation (as in FIGS. 1A-1D and 6A/6B) ready to repeat the process for the next arrow.

It should be noted that the inventive arrow rest assembly 100 can also be operated as a conventional limb-driven rest, simply by not actuating the switch and leaving the launcher 120 coupled to the lever 130. It should also be noted that the inventive arrow rest assembly 100 can be returned manually from its second or third stage of operation (after actuation of the switch but before drawing the bow) to its first stage of operation by simply pushing the launcher 120 back down to its launcher-down position, using the arrow shaft 98 or the user's hand. Upon reaching the aligned arrangement with the lever 130 in its brace position, the coupler can return to its coupled arrangement, resulting in the arrangement of the first stage of operation of the arrow rest assembly 100.

The inventive arrow rest assembly 100 enables a user of the bow, with the bow at brace, to move at will the launcher 120 between its launcher-up and launcher-down positions. For example, the launcher 120 in its launcher-up position, in conjunction with the upper containment arm 112, can enclose a nocked arrow and prevent it from falling off of the arrow rest before the user draws the bow (e.g., while a bowhunter moves about in search of a target with the arrow nocked and ready but with the bow undrawn). The inventive arrow rest assembly 100 provides the further advantage that said movement of the launcher 120 can be effected by actuating the switch using the shaft 98 of an arrow the user is holding nocked or positioned to be nocked onto the bowstring 24. Without that functionality, the user would have to remove the arrow, and perhaps even put it down or into a quiver, to free up a hand to actuate the switch, or alternatively exhibit a degree of dexterity sufficient to actuate a button with the hand holding the riser 20 or the hand holding the arrow.

Various components of the inventive arrow rest assembly can comprise any corresponding one or more suitable materials. Suitable materials can be selected based on any one or more of weight or density, strength, stiffness, resiliency, damping, friction reduction or enhancement, cost, durability, corrosion or wear resistance, and so on.

In addition to the preceding, the following example embodiments fall within the scope of the present disclosure or appended claims:

Example 1

An arrow rest assembly for an archery bow, the arrow rest assembly comprising: (a) a body structurally arranged for attachment to a riser of the bow; (b) a launcher engaged with the body, movable between a launcher-up position and a launcher-down position, and biased toward the launcher-up position; (c) a lever engaged with the body, movable between a brace position and a drawn position, and biased toward the drawn position; (d) a launcher-lever coupler movable between coupled and decoupled arrangements and biased toward the coupled arrangement, wherein (i) with the coupler in the coupled arrangement, the launcher and the lever are constrained to move together in an aligned arrangement, (ii) with the coupler in the coupled arrangement and the lever held in the brace position against bias force thereon, the launcher is held in the launcher-down position against bias force thereon, (iii) with the coupler in the coupled arrangement and the lever in the drawn position, the launcher is held in the launcher-up position, (iv) with the coupler in the decoupled arrangement, the launcher and the lever move independently and the launcher is moved to or held in the launcher-up position by the bias force thereon, and (v) with the coupler in the decoupled arrangement, relative motion of the launcher and the lever into the aligned arrangement enables biased movement of the coupler to the coupled arrangement; and (e) a switch arranged so that, with the coupler in the coupled arrangement and the lever held in the brace position against the bias force thereon, manual actuation of the switch results in movement of the coupler to the decoupled arrangement against the bias force thereon and biased movement of the launcher to the launcher-up position, the switch including an actuator positioned and arranged so that, with the arrow rest assembly attached to the riser of the bow, the switch can be actuated manually by pressing against the actuator a lateral surface of a shaft of an arrow nocked or positioned to be nocked onto a bowstring of the bow.

Example 2

The arrow rest assembly of Example 1 wherein the switch and the coupler are arranged so that only manual actuation of the switch enables biased movement of the launcher to the launcher-up position with the lever held in the brace position against the bias force thereon.

Example 3

The arrow rest assembly of any one of Examples 1 or 2 wherein the actuator comprises a paddle attached to the body and positioned so that, with the arrow rest assembly attached to the riser of the bow, the switch can be actuated manually by sideways movement, toward the riser against the paddle, of the shaft of the arrow nocked or positioned to be nocked onto the bowstring of the bow.

Example 4

The arrow rest assembly of any one of Examples 1 through 3 wherein the actuator comprises an upper containment arm attached to the body and positioned so that, with the arrow rest assembly attached to the riser of the bow, the switch can be actuated manually by upward movement, against the containment arm, of the shaft of the arrow nocked or positioned to be nocked onto the bowstring of the bow.

Example 5

The arrow rest assembly of any one of Examples 1 through 3 further comprising an upper containment arm substantially rigidly attached to the body an extending transversely above the launcher.

Example 6

The arrow rest assembly of any one of Examples 1 through 5 wherein the switch includes a button or a switch lever attached to the body and positioned so that the switch can be actuated manually by pressing the button or the switch lever.

Example 7

The arrow rest assembly of any one of Examples 1 through 6 further comprising a shaft engaged with the body, the shaft defining an arrow rest rotation axis, wherein: (b') the launcher is engaged with the body by engagement with the shaft and is rotatable about the axis between the launcher-up and launcher-down positions; (c') the lever is engaged with the body by engagement with the shaft and is rotatable about the axis between the brace and drawn positions; and (d') (i') with the coupler in the coupled arrangement, the launcher and the lever are constrained to rotate together about the axis in the aligned arrangement, (iv') with the coupler in the decoupled arrangement, the launcher and lever rotate independently about the axis and the launcher is rotated to or held in the launcher-up position by the bias force thereon, and (v') with the coupler in the decoupled arrangement, relative rotation of the launcher and the lever into the aligned arrangement enables biased movement of the coupler to the coupled arrangement.

Example 8

The arrow rest assembly of Example 7 wherein the body and shaft are arranged so that, with the arrow rest assembly attached to the riser of the bow, the rotation axis is substantially parallel to a shaft of an arrow nocked on a bowstring of the bow and ready to be shot from bow.

Example 9

The arrow rest assembly of Example 8 wherein the launcher includes a transverse arm extending from the shaft and having a V- or U-shaped portion, prongs, a fork, a notch, or a groove arranged for receiving and supporting a shaft of an arrow, and the launcher is arranged to move from the launcher-up position to the launcher-down position by rotation about the axis so that the transverse arm moves downward away from the shaft of the arrow.

Example 10

The arrow rest assembly of Example 7 wherein the body and shaft are arranged so that, with the arrow rest assembly attached to the riser of the bow, the rotation axis is substantially perpendicular to a shooting plane defined by a drawn bowstring of the bow.

Example 11

The arrow rest assembly of Example 10 wherein the launcher connected at a proximal end thereof to the shaft and arranged at a distal end thereof with a V- or U-shaped portion, prongs, a fork, a notch, or a groove arranged for receiving and supporting a shaft of an arrow, and the launcher is arranged to move from the launcher-up position to the launcher-down position by rotation about the axis so that the distal end moves downward away from the shaft of the arrow.

Example 12

The arrow rest assembly of any one of Examples 1 through 11 wherein: (i) the coupler includes either (1) a biased pin in the lever and a mating hole in the launcher or (2) a biased pin in the launcher and a mating hole in the lever; (ii) with the lever and the launcher in the aligned arrangement, the hole is aligned with the pin so as to enable the pin to engage the hole in response to bias force on the pin; and (iii) the switch is arranged so that, upon actuation of the switch with the lever held in the brace position against the bias force thereon and the pin held engaged with the hole by the bias force on the pin, the switch retracts the pin from the hole against the bias force on the pin, disengages the pin from the hole, and enables biased movement of the launcher to the launcher-up position.

Example 13

The arrow rest assembly of Example 12 wherein, with the coupler in the decoupled arrangement and the launcher in the launcher-up position, movement of the lever from the brace position to the drawn position aligns the pin with the hole, thereby enabling the pin to engage the hole in response to the bias force on the pin so as to move the coupler to the coupled arrangement.

Example 14

The arrow rest assembly of any one of Examples 12 or 13 wherein (i) the actuator includes a paddle and a button attached to the body, (ii) the paddle is positioned so that, with the arrow rest assembly attached to the riser of the bow, the switch can be actuated by sideways movement, toward the riser against the paddle, of a shaft of an arrow nocked on a bowstring of the bow, (iii) the button is positioned so that, with the arrow rest assembly attached to the riser of the bow, the switch can be actuated by pressing the button, and (iv) the paddle and the button are coupled to either a reciprocating member or a coupler lever, and (v) the reciprocating member or the coupler lever is arranged to retract the pin from the hole upon pressing of the button or movement of the shaft of the arrow against the paddle.

Example 15

The arrow rest assembly of any one of Examples 12 through 14 wherein (i) the actuator includes an upper containment arm and a button attached to the body, (ii) the upper containment arm is positioned so that, with the arrow rest assembly attached to the riser of the bow, the switch can be actuated by upward movement, against the upper containment arm, of a shaft of an arrow nocked on a bowstring of the bow, (iii) the button is positioned so that, with the arrow rest assembly attached to the riser of the bow, the switch can be actuated by pressing the button, and (iv) the upper containment arm and the button are coupled to either a reciprocating member or a coupler lever, and (v) the reciprocating member or the coupler lever is arranged to retract the pin from the hole upon pressing of the button or movement of the shaft of the arrow against the upper containment arm.

Example 16

The arrow rest assembly of any one of Examples 1 through 15 further comprising a coupling cable attached to the lever and to the bow and arranged so that, with the arrow rest assembly attached to the bow, (i) with the bow at brace, tension on the coupling cable holds the lever in the brace position against the bias force thereon, and (ii) with the bow drawn, lack of tension on the coupling cable enables biased movement of the lever to the drawn position.

Example 17

The arrow rest assembly of Example 16 wherein, with the arrow rest assembly attached to the bow, (i) with the bow at brace and the coupler in the coupled arrangement, tension on the coupling cable holds the launcher in launcher-down position against the bias force thereon, (ii) with the bow at brace, actuation of the switch moves the coupler against the bias force thereon to the decoupled arrangement and thereby enables biased movement of the launcher to the launcher-up position, (iii) with the bow drawn, the lever in the drawn position, and the launcher in the launcher-up position, the aligned arrangement of the lever and the launcher enables biased movement of the coupler to the coupled arrangement, and (iv) with the coupler in the coupled arrangement, return of the drawn bow to brace results in restored tension on the coupling cable, movement of the lever to the brace position against the bias force thereon, and movement of the launcher to the launcher-down position against the bias force thereon.

Example 18

The apparatus of any one of Examples 16 or 17 further comprising the bow, wherein the arrow rest assembly is attached to the bow by attachment of the body of the arrow rest assembly to the riser of the bow.

Example 19

A method for using the apparatus of Example 18, the method comprising: (A) with the bow at brace, the lever held in the brace position against the bias force thereon, the launcher held on the launcher-down position against the bias force thereon, and the coupler in the coupled arrangement, manually actuating the switch, using a shaft of an arrow nocked or positioned to be nocked onto the bow, to move the coupler to the decoupled arrangement against the bias force thereon and enable biased movement of the launcher to the launcher-up position; (B) placing the shaft of the arrow on the launcher and nocking the arrow onto a bowstring of the bow; (C) after parts (A) and (B), drawing the bow, thereby releasing tension on the coupling cable, enabling biased movement of the lever to the drawn position so that the lever and the launcher are in the aligned arrangement, and enabling biased movement of the coupler to the coupled arrangement; and (D) after part (C), releasing the bowstring to shoot the arrow and allow the bow to return to brace, thereby restoring tension on the coupling cable, moving the lever to the brace position against the bias force thereon, and moving the launcher to the launcher-down position against the bias force thereon.

It is intended that equivalents of the disclosed example embodiments and methods shall fall within the scope of the present disclosure or appended claims. It is intended that the disclosed example embodiments and methods, and equivalents thereof, may be modified while remaining within the scope of the present disclosure or appended claims.

In the foregoing Detailed Description, various features may be grouped together in several example embodiments for the purpose of streamlining the disclosure. This method of disclosure is not to be interpreted as reflecting an intention that any claimed embodiment requires more features than are expressly recited in the corresponding claim. Rather, as the appended claims reflect, inventive subject matter may lie in less than all features of a single disclosed example embodiment. Therefore, the present disclosure shall be construed as implicitly disclosing any embodiment having any suitable subset of one or more features—which features are shown, described, or claimed in the present application—including those subsets that may not be explicitly disclosed herein. A "suitable" subset of features includes only features that are neither incompatible nor mutually exclusive with respect to any other feature of that subset. Accordingly, the appended claims are hereby incorporated into the Detailed Description, with each claim standing on its own as a separate disclosed embodiment. In addition, each of the appended dependent claims shall be interpreted, only for purposes of disclosure by said incorporation of the claims into the Detailed Description, as if written in multiple dependent form and dependent upon all preceding claims with which it is not inconsistent. It should be further noted that the cumulative scope of the appended claims can, but does not necessarily, encompass the whole of the subject matter disclosed in the present application.

The following interpretations shall apply for purposes of the present disclosure and appended claims. The article "a" shall be interpreted as "one or more" unless "only one," "a single," or other similar limitation is stated explicitly or is implicit in the particular context; similarly, the article "the" shall be interpreted as "one or more of the" unless "only one of the," "a single one of the," or other similar limitation is stated explicitly or is implicit in the particular context. The conjunction "or" is to be construed inclusively (e.g., "a dog or a cat" would be interpreted as "a dog, or a cat, or both"; e.g., "a dog, a cat, or a mouse" would be interpreted as "a dog, or a cat, or a mouse, or any two, or all three"), unless: (i) it is explicitly stated otherwise, e.g., by use of "either . . . or," "only one of," or similar language; or (ii) two or more of the listed alternatives are mutually exclusive or incompatible within the particular context, in which case "or" would encompass only those combinations involving non-mutually-exclusive or compatible alternatives. Similarly, "one or more of a dog or a cat" would be interpreted as including (i) one or more dogs without any cats, (ii) one or more cats without any dogs, or (iii) one or more dogs and one or more cats, unless explicitly stated otherwise or some of the alternatives are understood or disclosed (implicitly or explicitly) to be mutually exclusive or incompatible. Similarly, "one or more of a dog, a cat, or a mouse" would be interpreted as (i) one or more dogs without any cats or mice, (ii) one or more cats without and dogs or mice, (iii) one or more mice without any dogs or cats, (iv) one or more dogs and one or more cats without any mice, (v) one or more dogs and one or more mice without any cats, (vi) one or more cats and one or more mice without any dogs, or (vii) one or more dogs, one or more cats, and one or more mice. "Two or more of a dog, a cat, or a mouse" would be interpreted as (i) one or more dogs and one or more cats without any mice, (ii) one or more dogs and one or more mice without any cats, (iii) one or more cats and one or more mice without and dogs, or (iv) one or more dogs, one or more cats, and one or more mice; "three or more," "four or more," and so on would be analogously interpreted. For any of the preceding recitations, if any pairs or combinations of the included alternatives are understood or disclosed (implicitly or explicitly) to be incompatible or mutually exclusive, such pairs or combinations are understood to be excluded from the corresponding recitation. For purposes of the present disclosure and appended claims, the words "comprising," "including," "having," and variants thereof, wherever they appear, shall be construed as open ended terminology, with the same meaning as if a phrase such as "at least" were appended after each instance thereof, unless explicitly stated otherwise.

For purposes of the present disclosure or appended claims, when terms are employed such as "about equal to," "substantially equal to," "greater than about," "less than about," and so forth, in relation to a numerical quantity, standard conventions pertaining to measurement precision and significant digits shall apply, unless a differing interpretation is explicitly set forth. For null quantities described by phrases such as "substantially prevented," "substantially absent," "substantially eliminated," "about equal to zero," "negligible," and so forth, each such phrase shall denote the case wherein the quantity in question has been reduced or diminished to such an extent that, for practical purposes in the context of the intended operation or use of the disclosed or claimed apparatus or method, the overall behavior or performance of the apparatus or method does not differ from that which would have occurred had the null quantity in fact been completely removed, exactly equal to zero, or otherwise exactly nulled.

For purposes of the present disclosure and appended claims, any labelling of elements, steps, limitations, or other portions of an embodiment, example, or claim (e.g., first, second, third, etc., (a), (b), (c), etc., or (i), (ii), (iii), etc.) is only for purposes of clarity, and shall not be construed as implying any sort of ordering or precedence of the portions so labelled. If any such ordering or precedence is intended, it will be explicitly recited in the embodiment, example, or claim or, in some instances, it will be implicit or inherent based on the specific content of the embodiment, example, or claim. In the appended claims, if the provisions of 35 USC § 112(f) are desired to be invoked in an apparatus claim, then the word "means" will appear in that apparatus claim. If those provisions are desired to be invoked in a method claim, the words "a step for" will appear in that method claim. Conversely, if the words "means" or "a step for" do not appear in a claim, then the provisions of 35 USC § 112(f) are not intended to be invoked for that claim.

If any one or more disclosures are incorporated herein by reference and such incorporated disclosures conflict in part or whole with, or differ in scope from, the present disclosure, then to the extent of conflict, broader disclosure, or broader definition of terms, the present disclosure controls. If such incorporated disclosures conflict in part or whole with one another, then to the extent of conflict, the later-dated disclosure controls.

The Abstract is provided as required as an aid to those searching for specific subject matter within the patent literature. However, the Abstract is not intended to imply that any elements, features, or limitations recited therein are necessarily encompassed by any particular claim. The scope of subject matter encompassed by each claim shall be determined by the recitation of only that claim.

What is claimed is:

1. An arrow rest assembly for an archery bow, the arrow rest assembly comprising:

(a) a body structurally arranged for attachment to a riser of the bow;

(b) a launcher engaged with the body, movable between a launcher-up position and a launcher-down position, and biased toward the launcher-up position;

(c) a lever engaged with the body, movable between a brace position and a drawn position, and biased toward the drawn position;

(d) a launcher-lever coupler movable between coupled and decoupled arrangements and biased toward the coupled arrangement, wherein (i) with the coupler in the coupled arrangement, the launcher and the lever are constrained to move together in an aligned arrangement, (ii) with the coupler in the coupled arrangement and the lever held in the brace position against bias force thereon, the launcher is held in the launcher-down position against bias force thereon, (iii) with the coupler in the coupled arrangement and the lever in the drawn position, the launcher is held in the launcher-up position, (iv) with the coupler in the decoupled arrangement, the launcher and the lever move independently and the launcher is moved to or held in the launcher-up position by the bias force thereon, and (v) with the coupler in the decoupled arrangement, relative motion of the launcher and the lever into the aligned arrangement enables biased movement of the coupler to the coupled arrangement; and (e) a switch arranged so that, with the coupler in the coupled arrangement and the lever held in the brace position against the bias force thereon, manual actuation of the switch results in movement of the coupler to the decoupled arrangement against the bias force thereon and biased movement of the launcher to the launcher-up position, the switch including an actuator positioned and arranged so that, with the arrow rest assembly attached to the riser of the bow, the switch can be actuated manually by pressing against the actuator a lateral surface of a shaft of an arrow nocked or positioned to be nocked onto a bowstring of the bow.

2. The arrow rest assembly of claim 1 wherein the arrow rest assembly is arranged so that only manual actuation enables biased movement of the launcher to the launcher-up position with the lever held in the brace position against the bias force thereon.

3. The arrow rest assembly of claim 1 wherein the actuator comprises a paddle attached to the body and positioned so that, with the arrow rest assembly attached to the riser of the bow, the switch can be actuated manually by sideways movement, toward the riser against the paddle, of the shaft of the arrow nocked or positioned to be nocked onto the bowstring of the bow.

4. The arrow rest assembly of claim 1 wherein the actuator comprises an upper containment arm attached to the body and positioned so that, with the arrow rest assembly attached to the riser of the bow, the switch can be actuated manually by upward movement, against the containment arm, of the shaft of the arrow nocked or positioned to be nocked onto the bowstring of the bow.

5. The arrow rest assembly of claim 1 wherein the switch includes a button or a switch lever attached to the body and positioned so that the switch can be actuated manually by pressing the button or the switch lever.

6. The arrow rest assembly of claim 1 further comprising an upper containment arm substantially rigidly attached to the body an extending transversely above the launcher.

7. The arrow rest assembly of claim 1 further comprising a shaft engaged with the body, the shaft defining an arrow rest rotation axis, wherein:

(b') the launcher is engaged with the body by engagement with the shaft and is rotatable about the axis between the launcher-up and launcher-down positions;

(c') the lever is engaged with the body by engagement with the shaft and is rotatable about the axis between the brace and drawn positions; and (d') (i') with the coupler in the coupled arrangement, the launcher and the lever are constrained to rotate together about the axis in the aligned arrangement, (iv') with the coupler in the decoupled arrangement, the launcher and lever rotate independently about the axis and the launcher is rotated to or held in the launcher-up position by the bias force thereon, and (v') with the coupler in the decoupled arrangement, relative rotation of the launcher and the lever into the aligned arrangement enables biased movement of the coupler to the coupled arrangement.

8. The arrow rest assembly claim 7 wherein the body and shaft are arranged so that, with the arrow rest assembly attached to the riser of the bow, the rotation axis is substantially parallel to a shaft of an arrow nocked on a bowstring of the bow and ready to be shot from bow.

9. The arrow rest assembly of claim 8 wherein the launcher includes a transverse arm extending from the shaft and having a V- or U-shaped portion, prongs, a fork, a notch, or a groove arranged for receiving and supporting a shaft of an arrow, and the launcher is arranged to move from the launcher-up position to the launcher-down position by rotation about the axis so that the transverse arm moves downward away from the shaft of the arrow.

10. The arrow rest assembly claim 7 wherein the body and shaft are arranged so that, with the arrow rest assembly attached to the riser of the bow, the rotation axis is substantially perpendicular to a shooting plane defined by a drawn bowstring of the bow.

11. The arrow rest assembly of claim 10 wherein the launcher is connected at a proximal end thereof to the shaft and arranged at a distal end thereof with a V- or U-shaped portion, prongs, a fork, a notch, or a groove arranged for receiving and supporting a shaft of an arrow, and the launcher is arranged to move from the launcher-up position to the launcher-down position by rotation about the axis so that the distal end moves downward away from the shaft of the arrow.

12. The arrow rest assembly of claim 1 wherein:

(i) the coupler includes either (1) a biased pin in the lever and a mating hole in the launcher or (2) a biased pin in the launcher and a mating hole in the lever;

(ii) with the lever and the launcher in the aligned arrangement, the hole is aligned with the pin so as to enable the pin to engage the hole in response to bias force on the pin; and (iii) the switch is arranged so that, upon actuation of the switch with the lever held in the brace position against the bias force thereon and the pin held engaged with the hole by the bias force on the pin, the switch retracts the pin from the hole against the bias force on the pin, disengages the pin from the hole, and enables biased movement of the launcher to the launcher-up position.

13. The arrow rest assembly of claim 12 wherein, with the coupler in the decoupled arrangement and the launcher in the launcher-up position, movement of the lever from the brace position to the drawn position aligns the pin with the hole, thereby enabling the pin to engage the hole in response to the bias force on the pin so as to move the coupler to the coupled arrangement.

14. The arrow rest assembly of claim 12 wherein (i) the actuator includes a paddle and a button attached to the body, (ii) the paddle is positioned so that, with the arrow rest assembly attached to the riser of the bow, the switch can be actuated by sideways movement, toward the riser against the paddle, of a shaft of an arrow nocked on a bowstring of the bow, (iii) the button is positioned so that, with the arrow rest assembly attached to the riser of the bow, the switch can be actuated by pressing the button, and (iv) the paddle and the button are coupled to either a reciprocating member or a coupler lever, and (v) the reciprocating member or the coupler lever is arranged to retract the pin from the hole upon pressing of the button or movement of the shaft of the arrow against the paddle.

15. The arrow rest assembly of claim 12 wherein (i) the actuator includes an upper containment arm and a button attached to the body, (ii) the upper containment arm is positioned so that, with the arrow rest assembly attached to the riser of the bow, the switch can be actuated by upward movement, against the upper containment arm, of a shaft of an arrow nocked on a bowstring of the bow, (iii) the button is positioned so that, with the arrow rest assembly attached to the riser of the bow, the switch can be actuated by pressing the button, and (iv) the upper containment arm and the button are coupled to either a reciprocating member or a coupler lever, and (v) the reciprocating member or the coupler lever is arranged to retract the pin from the hole upon pressing of the button or movement of the shaft of the arrow against the upper containment arm.

16. The arrow rest assembly of claim 1 further comprising a coupling cable attached to the lever and to the bow and arranged so that, with the arrow rest assembly attached to the bow, (i) with the bow at brace, tension on the coupling cable holds the lever in the brace position against the bias force thereon, and (ii) with the bow drawn, lack of tension on the coupling cable enables biased movement of the lever to the drawn position.

17. The arrow rest assembly of claim 16 wherein, with the arrow rest assembly attached to the bow, (i) with the bow at brace and the coupler in the coupled arrangement, tension on the coupling cable holds the launcher in launcher-down position against the bias force thereon, (ii) with the bow at brace, actuation of the switch moves the coupler against the bias force thereon to the decoupled arrangement and thereby enables biased movement of the launcher to the launcher-up position, (iii) with the bow drawn, the lever in the drawn position, and the launcher in the launcher-up position, the aligned arrangement of the lever and the launcher enables biased movement of the coupler to the coupled arrangement, and (iv) with the coupler in the coupled arrangement, return of the drawn bow to brace results in restored tension on the coupling cable, movement of the lever to the brace position against the bias force thereon, and movement of the launcher to the launcher-down position against the bias force thereon.

18. The apparatus of claim 17 further comprising the bow, wherein the arrow rest assembly is attached to the bow by attachment of the body of the arrow rest assembly to the riser of the bow.

19. A method for using the apparatus of claim 18, the method comprising:

(A) with the bow at brace, the lever held in the brace position against the bias force thereon, the launcher held on the launcher-down position against the bias force thereon, and the coupler in the coupled arrangement, manually actuating the switch, using a shaft of an arrow nocked or positioned to be nocked onto the bowstring, to move the coupler to the decoupled arrangement against the bias force thereon and enable biased movement of the launcher to the launcher-up position;

(B) placing the shaft of the arrow on the launcher and nocking the arrow onto a bowstring of the bow;

(C) after parts (A) and (B), drawing the bow, thereby releasing tension on the coupling cable, enabling biased movement of the lever to the drawn position so that the lever and the launcher are in the aligned arrangement, and enabling biased movement of the coupler to the coupled arrangement; and (D) after part (C), releasing the bowstring to shoot the arrow and allow the bow to return to brace, thereby restoring tension on the coupling cable, moving the lever to the brace position against the bias force thereon, and moving the launcher to the launcher-down position against the bias force thereon.

* * * * *